US006197493B1

(12) United States Patent
Ikesu et al.

(10) Patent No.: US 6,197,493 B1
(45) **Date of Patent: *Mar. 6, 2001**

(54) SILVER HALIDE COLOR PHOTOGRAPHIC LIGHT-SENSITIVE MATERIAL

(75) Inventors: Satoru Ikesu; Katsuji Ota, both of Hino (JP)

(73) Assignee: Konica Corporation (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/394,311

(22) Filed: Sep. 10, 1999

Related U.S. Application Data

(62) Division of application No. 08/967,493, filed on Nov. 11, 1997, now Pat. No. 6,004,379.

(30) Foreign Application Priority Data

Nov. 15, 1996 (JP) ..... 8-304571

(51) Int. Cl.[7] ..... G03C 1/08; G03C 7/26; G03C 7/32

(52) U.S. Cl. ..... 430/557; 430/543

(58) Field of Search ..... 430/543, 557

(56) References Cited

U.S. PATENT DOCUMENTS

| | | | | |
|---|---|---|---|---|
| 4,022,620 | | 5/1977 | Okumura et al. | 430/557 |
| 4,032,347 | | 6/1977 | Van Poucke et al. | 430/557 |
| 4,146,400 | | 3/1979 | Lowski et al. | 430/557 |
| 4,833,070 | | 5/1989 | Kunitz et al. | 430/557 |
| 5,066,574 | * | 11/1991 | Kubota et al. | 430/557 |
| 6,004,739 | * | 12/1999 | Ikesu et al. | 430/557 |

FOREIGN PATENT DOCUMENTS

| | | |
|---|---|---|
| 0415375 | 6/1991 | (EP) . |
| 1302398 | 11/1970 | (GB) . |
| 1525170 | 12/1976 | (GB) . |

* cited by examiner

*Primary Examiner*—Geraldine Letscher
(74) *Attorney, Agent, or Firm*—Jordan B. Bierman; Bierman, Muserlian and Lucas

(57) ABSTRACT

A silver halide color photographic light-sensitive material is disclosed. The light-sensitive material comprises a support having thereon a blue-sensitive silver halide emulsion layer containing a yellow dye-forming coupler represented by the following Formula I;

Formula I

Formula I wherein R, is an aliphatic group or an aromatic group, $R_2$ is an anti-diffusion aliphatic group or aromatic group, $R_3$ is a hydrogen atom or halogen atom, $Z_3$ is >N—$R_2$, in which $R_2$, is a hydrogen atom, an alkyl group, a cycloalkyl group, an aryl group, a heterocyclic group, or —O—, $Z_4$ is >N—$R_{22}$ in which $R_{22}$ is a hydrogen atom, an alkyl group, a cycloalkyl group, an aryl group, a heterocyclic group, or >C($R_{23}$) ($R_{24}$) in which $R_{23}$ and $R_{24}$ are each a hydrogen atom or a substituent.

10 Claims, No Drawings

SILVER HALIDE COLOR PHOTOGRAPHIC LIGHT-SENSITIVE MATERIAL

This is a Divisional Application of Ser. No. 08/967,493, filed Nov. 11, 1997, now U.S. Pat. No. 6,004,379.

FIELD OF THE INVENTION

This invention relates to a silver halide color photographic light-sensitive material, hereinafter simply referred to a color light-sensitive material, particularly relates to a color light-sensitive material containing a novel yellow coupler which can be produced with a lowered cost and is excellent in color-forming efficiency, color reproducibility and image storage ability, in a silver halide emulsion layer thereof.

BACKGROUND OF THE INVENTION

It is a recent trend in color light-sensitive material that a two-equivalent coupler, in which an appropriate substituent is introduced at the coupling position or reactive position at which the coupler is reacted with the oxidation product of a color developing agent so that one molecular of dye can be formed from the coupler by the reduction of two silver atoms, is used in place of a 4-equivalent coupler by which requires reduction of 4 silver atoms to form one molecule of dye.

Requirements to the coupler are increasingly made harder accompanied with progress in the color light-sensitive material and more improvements are required not only in the color-forming efficiency but also in a color reproducibility, a storage ability of image, a solubility in a high-boiling solvent and a stability of dispersion thereof.

As a technique for improving the color reproducibility and the color-forming efficiency, a yellow coupler has been known, which has a heterocyclic ring having a cyclic imide structure as a releasing group, and an alkoxy group at 2-position of the anilide moiety of the coupler. For example, Japanese Patent Publication Open for Public Inspection (JP O.P.I.) No. 63-38932 describes a yellow coupler having an alkoxy group at 2-position of the anilide moiety thereof and a hydantoin group or a imidazolone group as a releasing group thereof. However, such the coupler has a drawback that the coupler is inferior in the color reproducibility and the light-fastness since a sulfamoyl group is exist as a ballast group.

A yellow coupler improved in the light-fastness while maintaining a high color reproducibility and color-forming efficiency such as one described in JP O.P.I. No. 63-123047 has been known, which has an alkoxy group at 2-position and an acylamino group at 5-position of the anilide moiety. However, such the coupler is inferior in a solubility in a low-boiling solvent such as ethyl acetate and a high-boiling solvent such as dibutyl phthalate. Accordingly, a problem inconvenient to production of color light-sensitive material that a large amount of the solvent is necessary to disperse the coupler is raised. Furthermore, the coupler has a drawback that the coupler tends to be precipitated after dissolved in the solvent. It has been found that such the drawbacks become a impediment to the practical use of the coupler since the drawback are considerably emphasized under a condition for reducing the layer thickness, which is strongly required in recent years. Furthermore, the coupler described in this document is characterized in that a sulfonyl group is included in the ballast group thereof. For introducing the sulfonyl group, a complex synthesis procedure is required and the production cost is made higher.

U.S. Pat. No. 4,338,403 describes a yellow coupler having an alkoxy group at 2-position and a sulfonylamino group at 5-position of the anilide moiety and an imidazolyl group as a releasing group. Although such the coupler has a sufficient light-fastness and stability of dispersion, the coupler is required further improvement in the color-forming efficiency which is the most important property of color-forming coupler.

In European Patent No. 416684, a yellow is described which has an alkoxy group at 2-position and a sulfonylamino group at 5-position of the anilide moiety and an aryloxy group as the releasing group. Such the coupler has a high color-forming efficiency caused by the presence of the aryloxy group, However, the presence of the aryloxy group causes lowering in the light-fastness of the coupler and the lowered light-fastness makes a large impediment to the practical use of the coupler particularly in a color photographic paper.

SUMMARY OF THE INVENTION

The first object of the invention is to provide a color light-sensitive material which contains a novel 2-equivalent yellow coupler which can be produced with a lowered cost and is excellent in the color-forming efficiency.

The second object of the invention is to provide a color light-sensitive material containing a novel 2-equivalent coupler which forms a dye having an excellent image storage ability, particularly an excellent light-fastness, and a sharp spectral absorption of visible light necessary for making a high fidelity of color reproduction and gives a bright color image.

The above-mentioned objects of the invention can be attained by a silver halide color photographic light-sensitive material comprising a support having thereon a blue-sensitive silver halide emulsion layer which contains a yellow dye forming coupler, hereinafter referred to a yellow coupler, represented by the following Formula I;

Formula I

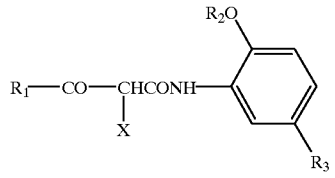

wherein $R_1$ is an aliphatic group or an aromatic group, $R_2$ is a anti-diffusion aliphatic or aromatic group, $R_3$ is a hydrogen atom or a halogen atom, and X is a 5- or 6-member nitrogen-containing heterocyclic group capable of being released upon coupling reaction with the oxidation product of a color developing agent.

In the above Formula I, the aliphatic group represented by $R_1$ includes a straight- or branched-chain alkyl group such as a methyl group, an ethyl group, an iso-propyl group, a t-butyl group, a n-dodecyl group, and a 1-hexylnonyl group. The alkyl group represented by $R_1$ may have a substituent. As the substituent the following groups can be cited; for example, a halogen atom such as a chlorine atom and a bromine atom, an aryl group such as a phenyl group and a p-t-octylphenyl group, an alkoxy group such as a methoxy group, an aryloxy group such as a 2,4-di-t-aminophenoxy group, a sulfonyl group such as a methanesulfonyl group, an acylamino group such as an acetylamino group and a benzoylamino group, a sulfonylamino group such as a n-dodecanesulfonylamino group, and a hydroxyl group.

The aromatic group represented by $R_1$ in Formula I includes preferably an aryl group having 6 to 14 carbon atoms such as a phenyl group, a 1-naphthyl group and a 9-anthranyl group. The aryl group represented by $R_1$ may further have a substituent. The following groups may be cited as the substituent; for example, a nitro group, a cyano group, an amino group such as a dimethylamino group and an anilino group, an alkylthio group such as a methylthio group, an alkyl group the same as that represented by $R_1$ and the group cited as the substituent of the alkyl group represented by $R_1$ of Formula I.

As the group represented by group $R_1$, an alkyl group is preferable, and a branched-chain alkyl group is more preferable and a t-butyl group is particularly preferable.

As the anti-diffusion aliphatic group, a straight- or branched-chain alkyl group having 8 to 21 carbon atoms such as a 2-ethylhexyl group, an iso-tridecyl group, a hexadecyl group and an octadecyl group, is preferable. The ant-diffusion alkyl group may have a structure having an interposed functional group such as that represented by the following Formula II.

Formula II $$—J—X—R_{12}$$

In the formula, J is a straight or branched-chain alkylene group having 1 to 20 carbon atoms such as a methylene group, a 1,1-dimethylene group and a 1-decylmethylene group, and $R_{12}$ is a straight or branched alkyl group having 1 to 20 carbon atoms such as that the same as that represented by $R_1$ of Formula I. X is a bonding of —O—, —OCO—, —$OSO_2$—, —CO—, —COO—, —CON($R_{13}$)—, —CON($R_{13}$)$SO_2$—, —N($R_{13}$)—, —N($R_{13}$)CO—, —N($R_{13}$)$SO_2$—, —N($R_{13}$)CON($R_{14}$)—, —N($R_{13}$)COO—, —S(O)$_n$I—, —S(O),N($R_{13}$)— or —S(O)$_n$N($R_{13}$)CO—. In the above formula, $R_{13}$ and $R_{14}$ are each a hydrogen atom, an alkyl group or an aryl group each the same as that represented by $R_1$ in Formula I, n is 0, 1 or 2, and $R_{12}$ may be bonded with J to form a ring.

The alkyl group represented by $R_2$ may have a substituent. In such the case, the substituent may be a group, for example, the same as that described as the substituent of the alkyl group represented by $R_1$ of Formula I.

As the anti-diffusion aromatic group represented by $R_2$ in Formula I, for example, a group the same as the aryl group represented by $R_1$ in Formula I is cited. The aryl group represented by $R_{12}$ may have a substituent. As the substituent, for example, a group the same as that described as the substituent of the aryl group represented by $R_1$ is cited. Among the substituents of the aryl group represented by $R_2$, a straight or branched alkyl group having 4 to 10 carbon atoms is preferred. In Formula I, $R_2$ is preferably an anti-diffusion aliphatic group, more preferably a straight chain alkyl group having a 8 to 21 carbon atoms.

In Formula I, $R_3$ is a hydrogen atom or a halogen atom. As the halogen atom, a chlorine atom and a bromine atom are cited. $R_3$ is preferably a chlorine atom.

In Formula I, $R_3$ is a nitrogen-containing heterocyclic group capable of being released at the time of coupling with the oxidation product of a color developing agent. The group is represented by the following Formula III.

Formula III

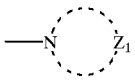

In Formula III, $Z_1$ is a group of non-metal atoms necessary to form a 5- or 6-member ring together with the nitrogen atom. A group of atoms for forming the non-metal atom group includes a substituted or unsubstituted methylene or methine group, >C═O, >N—$R_{15}$, in which $R_{15}$ is a hydrogen atom, an alkyl group, a cycloalkyl group, an aryl group or a heterocyclic group, —N═, —O— and —S(O)$_m$—, in which m is 0, 1 or 2.

The heterocyclic group represented by X in Formula III is preferably a group represented by Formula IV, V, VI, VII, VIII or IX.

Formula IV

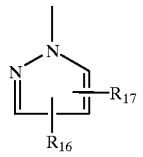

Formula V

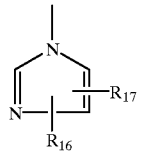

Formula VI

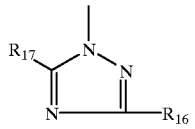

Formula VII

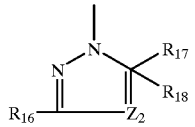

Formula VIII

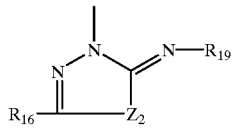

Formula IX

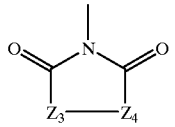

In Formulas IV, V. VI, VII and VIII, $R_{16}$, $R_{17}$ and $R_{18}$ are each a group capable of being a substituent of the nitrogen-containing heterocyclic ring, for example, a group the same as the group cited as the substituent of the alkyl group or the aryl group represented by $R_1$ in Formula I.

In Formula VIII, $R_{19}$ is, for example, an alkyl group or aryl group the same as that represented by $R_1$ in Formula I, a carbonyl group including an alkylcarbonyl group such as an acetyl group and a trifluoroacetylpivaloyl group, and an arylcarbonyl group such as a benzoyl group, a pentafluorobenzoyl group and a 3,5-di-t-butyl-4-hydroxybenzoyl group, or a sulfonyl group including an alkylsulfonyl group such as a methanesulfonyl group and a trifluoromethanesulfonyl group, and an arylsulfonyl group such as a p-toluenesulfonyl group.

In Formula VII or VIII, $Z_2$ is >N—$R_{20}$ in which $R_{20}$ is a group the same as that represented by $R_{15}$ of $Z_1$ of Formula III, —O— or —S(O)$_k$— in which k is 0, 1 or 2.

In Formula IX, $Z_3$ is >N—$R_{21}$ in which $R_{21}$ is a group the same as that represented by $R_{15}$ of $Z_1$ in Formula III, or —O—.

In Formula IX, $Z_4$ is >N—$R_{22}$ in which $R_{22}$ is a group the same as that represented by $R_{15}$ of $Z_1$ in Formula III, or >C($R_{23}$) ($R_{24}$) in which $R_{23}$ and $R_{24}$ are each a hydrogen atom or a group the same as that cited as the substituent of the alkyl group or the aryl group represented by $R_1$ in Formula I.

In the coupler relating to the invention, it is particularly preferable that the nitrogen-containing heterocyclic group X represented by Formula III is the group represented by Formula IX.

Molecules of the 2-equivalent yellow coupler represented by Formula I may be bonded with each other at any of the substituent to form a bis-, tris-, tetrakis-compound or a polymerized compound.

Examples of the 2-equivalent yellow coupler represented by Formula I are shown below.

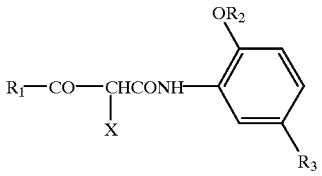

| No. | $R_1$ | $R_2$ | $R_3$ | X |
|---|---|---|---|---|
| (1) | $(CH_3)_3C$— | —$C_{18}H_{37}$ | H | 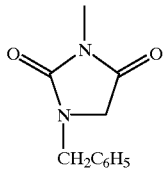 |
| (2) | $(CH_3)_3C$— | —$C_{18}H_{37}$ | H | 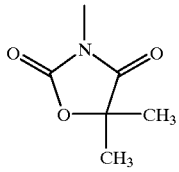 |
| (3) | $(CH_3)_3C$— | —$C_{16}H_{33}$ | H | 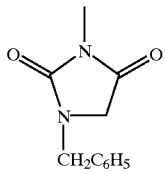 |
| (4) | $(CH_3)_3C$— | —$C_{16}H_{33}$ | H | 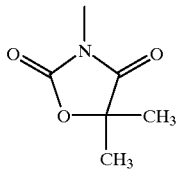 |
| (5) | $(CH_3)_3C$— | —$C_{14}H_{29}$ | H | 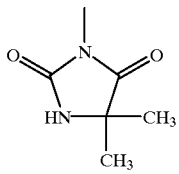 |

-continued
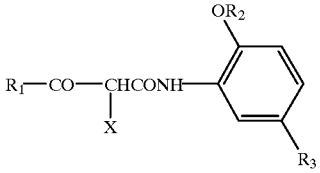
| No. | $R_1$ | $R_2$ | $R_3$ | X |
|---|---|---|---|---|
| (6) | $(CH_3)_3C$— | —$C_{14}H_{29}$ | H | 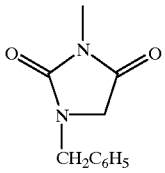 |
| (7) | $(CH_3)_3C$— | —$C_{14}H_{29}$ | H | 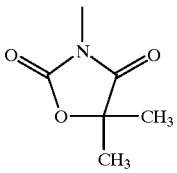 |
| (8) | $(CH_3)_3C$— | —$C_{12}H_{25}$ | H | 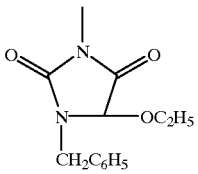 |
| (9) | $(CH_3)_3C$— | —$CH_2CO_2C_{12}H_{25}$ | H | 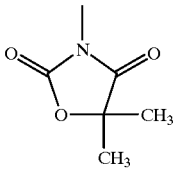 |
| (10) | $(CH_3)_3C$— | —$CH(C_4H_9)CO_2C_{12}H_{25}$ | H | 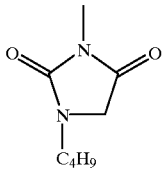 |
| (11) | $(CH_3)_3C$— | 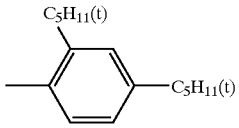 | H | 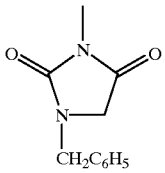 |
| (12) | $(CH_3)_3C$— | 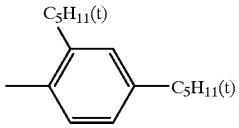 | H | 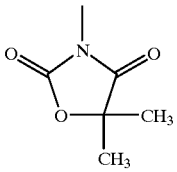 |

-continued
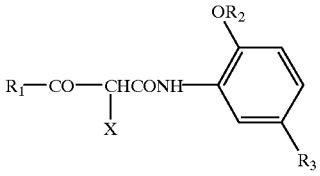
| No. | $R_1$ | $R_2$ | $R_3$ | X |
|---|---|---|---|---|
| (13) | $(CH_3)_3C$— | 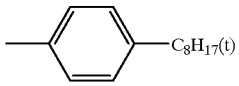 | H | 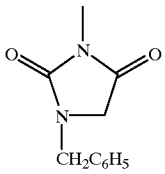 |
| (14) | $(CH_3)_3C$— | 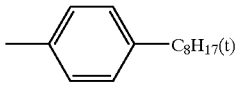 | H | 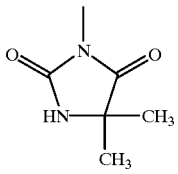 |
| (15) | $(CH_3)_3C$— | 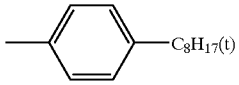 | H | 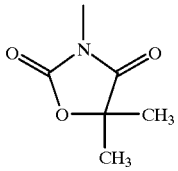 |
| (16) | $(CH_3)_3C$— | 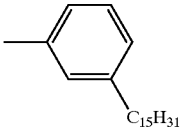 | H | 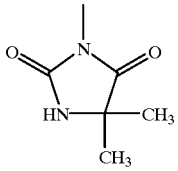 |
| (17) | $(CH_3)_3C$— | 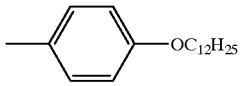 | H | 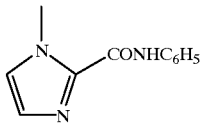 |
| (18) | $(CH_3)_3C$— | —$C_{18}H_{37}$ | Cl | 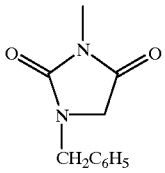 |
| (19) | $(CH_3)_3C$— | —$C_{18}H_{37}$ | Cl | 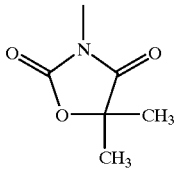 |

-continued
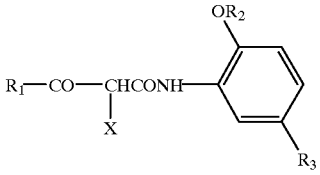
| No. | $R_1$ | $R_2$ | $R_3$ | X |
|---|---|---|---|---|
| (20) | $(CH_3)_3C$— | —$C_{16}H_{33}$ | Cl | 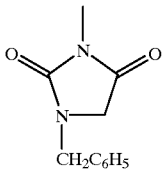 |
| (21) | $(CH_3)_3C$— | —$C_{16}H_{33}$ | Cl | 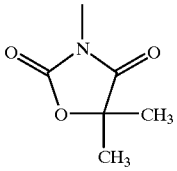 |
| (22) | $(CH_3)_3C$— | —$C_{14}H_{29}$ | Cl | 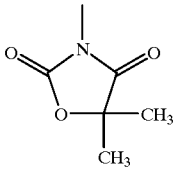 |
| (23) | $(CH_3)_3C$— | —$C_{14}H_{29}$ | Cl | 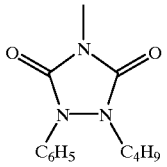 |
| (24) | $(CH_3)_3C$— | —$C_{14}H_{29}$ | Cl | 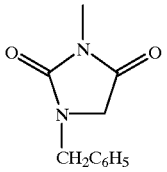 |
| (25) | $(CH_3)_3C$— | —$C_{12}H_{25}$ | Cl | 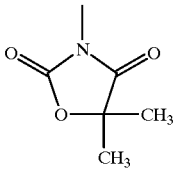 |
| (26) | $(CH_3)_3C$— | —$C_{12}H_{25}$ | Cl | 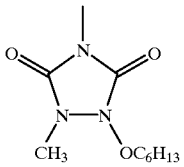 |

-continued
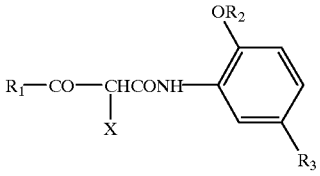
| No. | $R_1$ | $R_2$ | $R_3$ | X |
|---|---|---|---|---|
| (27) | $(CH_3)_3C$— | —$C_{12}H_{25}$ | Cl | 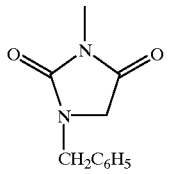 |
| (28) | $(CH_3)_3C$— | —$C_{10}H_{21}$ | Cl | 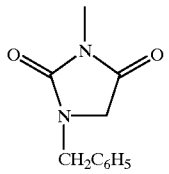 |
| (29) | $(CH_3)_3C$— | —$C_{10}H_{21}$ | Cl | 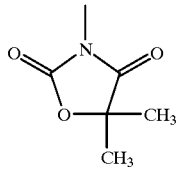 |
| (30) | $(CH_3)_3C$— | —$CH_2CO_2C_{14}H_{29}$ | Cl | 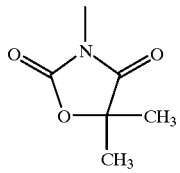 |
| (31) | $(CH_3)_3C$— | —$CH_2CON(C_8H_{17}\text{-t})_2$ | Cl | 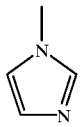 |
| (32) | $(CH_3)_3C$— | 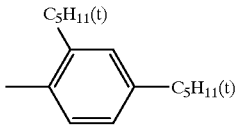 | Cl | 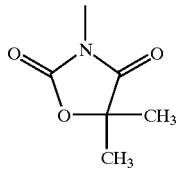 |
| (33) | $(CH_3)_3C$— | 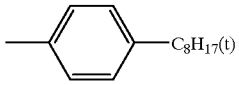 | Cl | 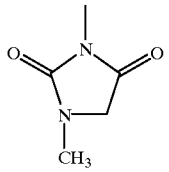 |

-continued
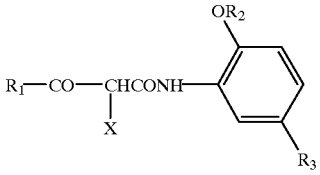
| No. | $R_1$ | $R_2$ | $R_3$ | X |
|---|---|---|---|---|
| (34) | 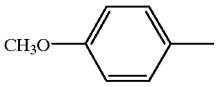 | $—C_{18}H_{37}$ | Cl | 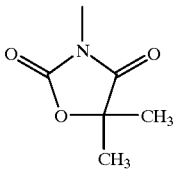 |
| (35) | 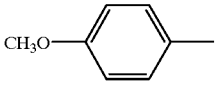 | $—C_{12}H_{25}$ | Cl | 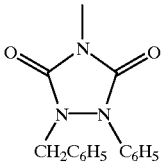 |
| (36) | 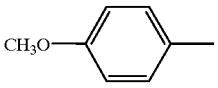 | $—CH_2CO_2C_{12}H_{25}$ | Cl | 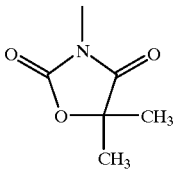 |
| (37) | 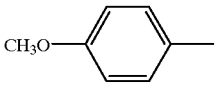 | 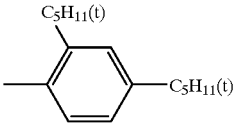 | Cl | 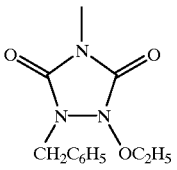 |
| (38) | 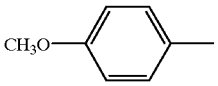 | 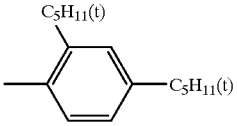 | Cl | 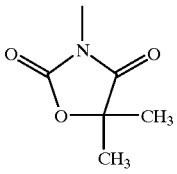 |
| (39) | 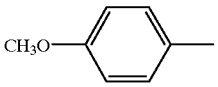 | 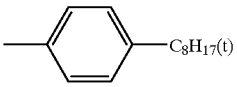 | H | 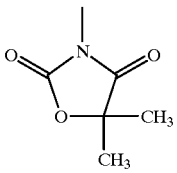 |
| (40) | 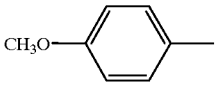 | 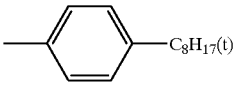 | H | 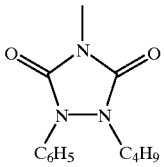 |

-continued
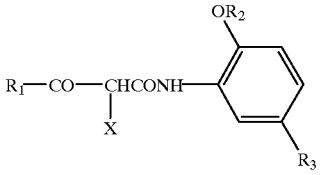
| No. | $R_1$ | $R_2$ | $R_3$ | X |
|---|---|---|---|---|
| (41) | 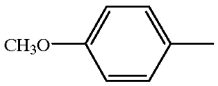 | 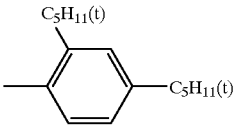 | Cl | 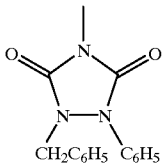 |
| (42) | 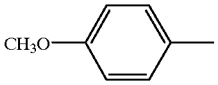 | 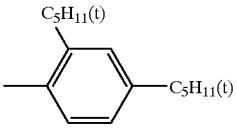 | Cl | 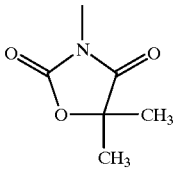 |
| (43) | 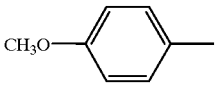 | 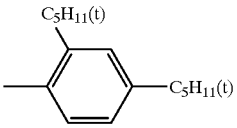 | Cl | 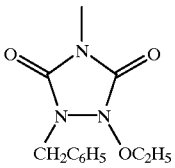 |
| (44) | 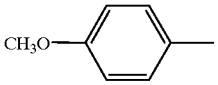 | 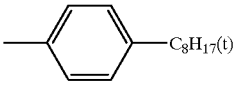 | Cl | 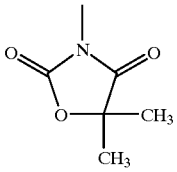 |
| (45) | 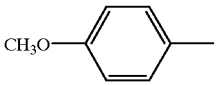 | 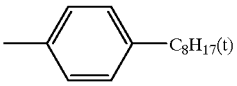 | Cl | 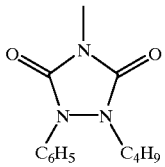 |
| (46) | 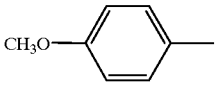 | 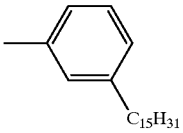 | Cl | 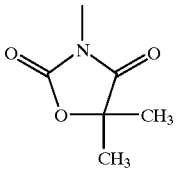 |
| (47) | 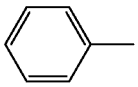 | 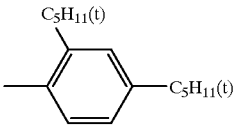 | H | 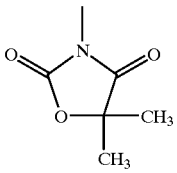 |

-continued

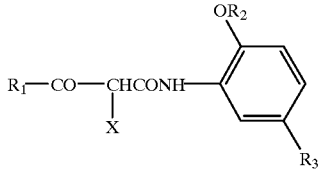

| No. | $R_1$ | $R_2$ | $R_3$ | X |
|---|---|---|---|---|
| (48) | $(CH_3)_3C$— | 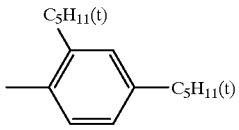 | Cl | 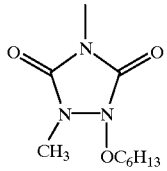 |
| (49) | $(CH_3)_3C$— | —$C_{16}H_{33}$ | Br | 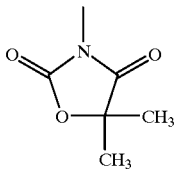 |

The yellow coupler represented by Formula I of the invention can be easily synthesized by a known method. A typical synthesizing procedure is shown below.

SYNTHESIZING EXAMPLE 1

Synthesis of Exemplified Compound 27

Exemplified Compound 27 is synthesized according to the following scheme.

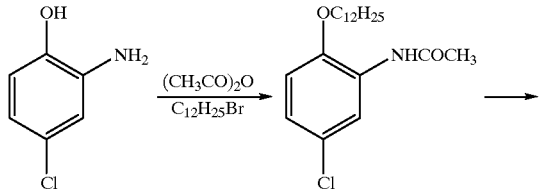

(27a)

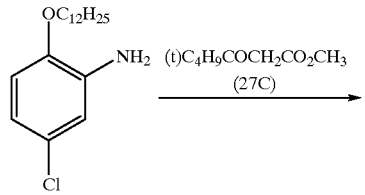

(27b)

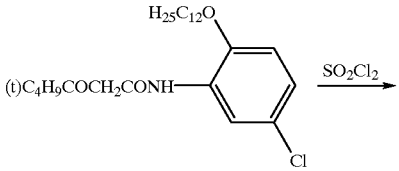

(27d)

-continued

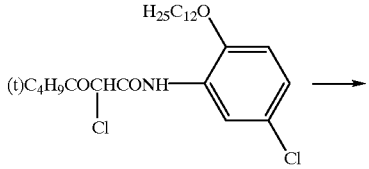

(27e)

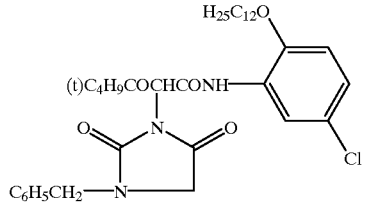

(Exemplified Compound 27)

1) Synthesis of intermediate 27a

In 900 ml of 2-butanol, 144 g, 1 mole, of 2-amino-4chlorophenol is dispersed at a temperature of 40 to 50° C. and 103 g, 1.01 moles, of glacial acetic anhydride is dropped into the dispersion while stirring. The mixture is reacted for 1.5 hours at 40° C. after completion of the addition of acetic anhydride. After completion of the reaction, 42 g, 1.05 moles, of sodium hydroxide and 262 g, 1.05 moles, of dodecyl bromide is added and reacted for 9 hours at approximately 85° C. while stirring and heating. The reacting liquid is cooled by standing and washed twice by a 10% solution of sodium carbonate, once by a diluted sulfuric acid and twice by a solution of sodium Chloride. Then the organic liquid layer is separated and concentrated under a reduced pressure. The obtained residue is recrystallized using 600 ml of ethanol. Thus 326 g of intermediate 27a is obtained with a yield of 92%.

2) Synthesis of Exemplified Compound 27

In a mixture of 1 liter of methanol and 55 ml of water, 354 g, 1 mole, of intermediate 27a is dispersed and 196 g, 2 moles, of concentrated sulfuric acid is dropped to the dispersion. After completion of the addition of sulfuric acid, the mixture is heated and refluxed for 4 hours. The solvent of the reacting liquid is removed under a reduced pressure. To the residue, 1.3 1 of toluene and a 28% solution of sodium carbonate are added to extract a solvent soluble composition into an organic solvent layer. The organic solvent layer is washed once by a 28% solution of sodium carbonate and three times by a solution of sodium chloride and dehydrated by co-boiling. Thus a toluene solution of intermediate 27b is obtained.

To the solution of intermediate 27b, 166 g. 1.05 moles, of 27c is added and reacted for 12 hours while removing methanol formed by the reaction. Thus a toluene solution of intermediate 27d is obtained.

To the toluene solution of intermediate 27d, 135 g. 1 mole, of sulfuryl chloride is dropped at 40° C. After completion of the addition of sulfuryl chloride, the reaction is carried out for 2 hours at the same temperature. After completion of the reaction, the solvent for reaction is removed under a reduced pressure. Thus intermediate 27e is obtained. In 1250 ml of acetone, intermediate 27e is dissolved and 247g, 1.3 moles, of benzylhydantoin and 180 g, 1.3 moles, of potassium carbonate are added and reacted for 5 hours by heating and refluxing.

After the reaction, acetone is removed under a reduced pressure and 1250 ml of ethyl acetate and 400 ml of water are added for extracting the organic solvent-soluble composition into a organic solvent layer. The organic solvent layer is washed twice by a 10% solution of sodium carbonate, once by a diluted sulfuric acid and three times by a solution of sodium chloride, and concentrated under a reduced pressure. Thus obtained residue is recrystallized by 1250 ml of 2-propanol.

Then 576 g Exemplified Compound 27 is obtained with a yield of 92%. The chemical structure of thus obtained Exemplified Compound is confirmed by NMR, IR and mass-spectrum thereof.

SYNTHESIS EXAMPLE 2

Synthesis of Exemplified Compound 19

Exemplified Compound 19 is synthesized according to the following scheme.

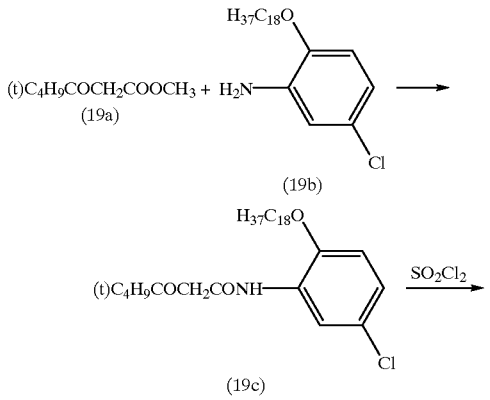

-continued

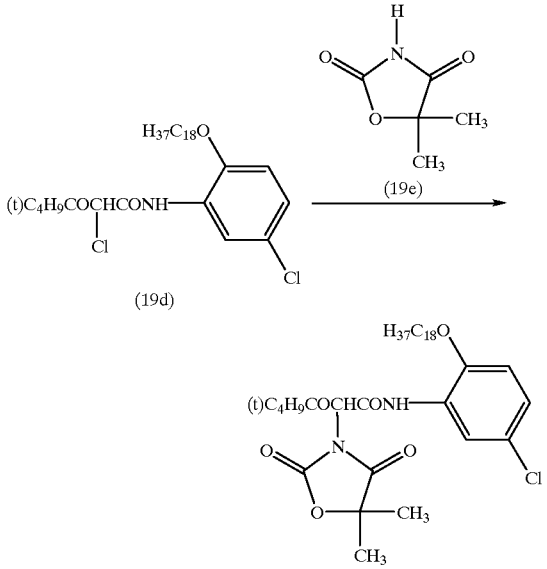

(Exemplified Compound 19)

1) Synthesis of intermediate 19c

In 300 ml of xylene, 34.8 g, 0.22 moles, of 19a and 79.2 g, 0.20 moles, of 19b are reacted for 3.5 hours by heating and refluxing while removing methanol formed by the reaction.

After reaction, the solvent is removed under a reduced pressure. The residue is recrystallized from 300 ml of ethanol and 91.8 g of intermediate 19c is obtained with a yield of 88%.

2) Synthesis of intermediate 19d

In 300 ml of ethyl acetate, 60 g, 0.115 moles, of intermediate 19c is dissolved and sulfuryl chloride is gradually dropped to the solution at about 30° C.

After completion of the addition, the liquid is stirred for 1 hour at the same temperature and the solvent ig removed. Thus 65.6 g of intermediate 19d is obtained with a yield of 103%.

Intermediate 19d is used to next step without purification.

3) Synthesis of Exemplified Compound 19

In 45 ml of acetone, 15 g, 26.9 milimoles, of intermediate 19d is dissolved and 4.83 g, 34.9 milimoles, of potassium carbonate and 4.51 g, 34.9 milimoles, of 19e are added to the solution, and are refluxed for 4 hours. After completion of the reaction, ethyl acetate and water added to extract the solvent-soluble composition in an organic solvent layer. The organic solvent layer is washed by diluted hydrochloric acid and three times by water. Then the solvent is removed from the extract. The residue thus obtained is recrystallized by 50 ml of ethanol and 10 ml of ethyl acetate. Thus 14.7 g of Exemplified Compound 19 is obtained with a yield of 84%.

The chemical structure of thus obtained Exemplified Compound 19 is confirmed by NMR, IR and mass-spectrum thereof. Exemplified couplers other than Exemplified Compounds 19 and 27 are synthesized by a method similar to the above-mentioned each using a raw material corresponding to each of the coupler.

The coupler of the invention can be used solely or in combination of two or more kinds thereof. The coupler can be used with a known pivaloylacetoanilide type or benzoylacetoanilide type yellow coupler in combination without any limitation.

The yellow coupler of the invention can be added to a silver halide photographic emulsion, for example, by the following method. The yellow coupler is dissolved in one or more kind of organic solvent selected from high-boiling organic solvents each having a boiling point of not less than 175° C. such as tricresyl phosphate or dibutyl phthalate and a low-boiling organic solvent usually used for preparing a coupler dispersion such as ethyl acetate, methanol, acetone, chloroform, methyl chloride or butyl propionate. The solution is mixed with a gelatin solution containing a surfactant, and is dispersed by a high-speed rotating mixer or a colloid mill. Thus obtained dispersion is added to the emulsion directly or after removing the low-boiling solvent by setting, cutting and washing by water.

The yellow coupler relating to the invention is added to a blue-sensitive emulsion layer of the light-sensitive material. It is preferred that the yellow coupler is added to the blue-sensitive emulsion layer in an amount of $1\times10^{-3}$ moles to 1 mole per mole of silver halide. The amount of the yellow coupler can be varied without the above-mentioned range according to the purpose of the use.

The yellow coupler according to the invention can be applied for any kind of color light-sensitive material having any purpose. In the color light-sensitive material of the invention, any kind of silver halide such as silver chloride, silver bromide, silver iodide, silver chlorobromide, silver iodobromide and silver chloroiodobromide can be used.

In the color light-sensitive material of the invention, another coupler can be contained together with the yellow coupler according to the invention to form a multi-color image.

In the color light-sensitive material of the invention, various kinds of additives such as a color fog preventing agent, an image stabilizing agent, a hardener, a plasticizer, a polymer latex, a formalin scavenger, a mordant, a development accelerator, a development delaying agent, a fluorescent whitening agent, a matting agent, a solvent, an antistatic agent and a surfactant can be optionally used.

A durability of a yellow image formed in the color light-sensitive material containing the yellow coupler according to the invention can be raised further by adding a UV absorbent to the light-sensitive material.

EXAMPLES

Example 1

A paper support was prepared which was laminated with a polyethylene layer on a surface and a titanium oxide-containing polyethylene layer on another surface. Sample 101 of multi-layered silver halide color photographic light-sensitive material was prepared by coating layers each having the following constitution on the titanium oxide-containing polyethylene layer laminated surface of the support. Coating liquids of each layers were prepared as follows.

Coating liquid of first layer To 26.7 g of yellow coupler Y-1, 10.0 g of dye image stabilizing agent ST-1, 6.67 g of dye image stabilizing agent ST-2, 0.67 g of additive HQ-1, 0.34 g of antihalation dye AI-3 and 0.67 g of high-boiling solvent DNP, 60 ml of ethyl acetate was added to dissolve the above-mentioned ingredients. Thus obtained solution was dispersed in 200 ml of a 10% gelatin solution containing 7 ml of 20% solution of surfactant SU-1 by an ultrasonic homogenizer to prepare a yellow coupler dispersion. The dispersion was mixed with a blue-sensitive silver halide emulsion prepared according to the later-mentioned condition which contains 8.68 g of silver to prepare a coating liquid of the first layer.

Coating liquids of the second to seventh layers were each prepared by a method similar to that of the first layer coating liquid.

Hardeners H-1 was added to the second and fourth layers and hardener H-2 was added to the seventh layer. Surfactants SU-2 and SU-3 were added as coating aids to control the surface tension of the coating liquid.

The constitutions the layers are listed below in which the amount is described in g/m$^2$ and the amount of the emulsion is described in terms of silver.

| | Coating amount |
|---|---|
| Seventh layer: Protective layer | |
| Gelatin | 1.0 |
| Silica (average particle size: 3 $\mu$m) | 0.03 |
| Color-mixing preventing agent HQ-2 | 0.002 |
| Color-mixing preventing agent HQ-3 | 0.002 |
| Color-mixing preventing agent HQ-4 | 0.004 |
| Color-mixing preventing agent HQ-5 | 0.02 |
| DIDP | 0.005 |
| Compound F-1 | 0.002 |
| Sixth layer: Interlayer | |
| Gelatin | 0.4 |
| UV absorbent UV-1 | 0.1 |
| UV absorbent UV-2 | 0.04 |
| UV absorbent UV-3 | 0.16 |
| Color-mixing preventing agent HQ-5 | 0.04 |
| DNP | 0.2 |
| PVP | 0.03 |
| Anti-irradiation dye AI-2 | 0.02 |
| Anti-irradiation dye AI-4 | 0.01 |
| Fifth layer: Red-sensitive layer | |
| Gelatin | 1.3 |
| Red-sensitive silver chlorobromide emulsion spectrally sensitized by sensitizing dye RS-1 (AgBr: 80 mole-%, AgCl: 20 mole-%) | 0.21 |
| Cyan coupler C-1 | 0.17 |
| Cyan coupler C-2 | 0.25 |
| Color-mixing preventing agent HQ-1 | 0.02 |
| HBS-1 | 0.2 |
| DOP | 0.2 |
| Anti-irradiation dye AI-1 | 0.01 |
| Fourth layer: Interlayer | |
| Gelatin | 0.94 |
| UV absorbent UV-1 | 0.28 |
| UV absorbent UV-2 | 0.09 |
| UV absorbent UV-3 | 0.38 |
| Color-mixing preventing agent HQ-5 | 0.10 |
| DNP | 0.4 |
| Third layer: Green-sensitive layer | |
| Gelatin | 1.2 |
| Green-sensitive silver chlorobromide emulsion spectrally sensitized by sensitizing dye GS-1 (AgBr: 80 mole-%, AgCl: 20 mole-%) | 0.35 |
| Magenta coupler M-1 | 0.23 |
| Color image stabilizing agent ST-3 | 0.20 |
| Color image stabilizing agent ST-4 | 0.17 |
| DIDP | 0.13 |
| DBP | 0.13 |
| Anti-irradiation dye AI-3 | 0.01 |
| Second layer: Interlayer | |
| Gelatin | 1.2 |
| Color-mixing preventing agent HQ-2 | 0.03 |
| Color-mixing preventing agent HQ-3 | 0.03 |
| Color-mixing preventing agent HQ-4 | 0.05 |
| Color-mixing preventing agent HQ-5 | 0.23 |
| DIDP | 0.13 |
| Compound F-1 | 0.002 |
| First layer: Blue-sensitive layer | |
| Gelatin | 1.2 |
| Blue-sensitive silver chlorobromide emulsion spectrally sensitized by sensitizing dye BS-1 | 0.26 |
| (AgBr: 80 mole-%, AgCl: 20 mole-%) | 0.26 |

-continued

| | Coating amount |
|---|---|
| Yellow coupler Y-1 | 0.80 |
| Color image stabilizing agent ST-1 | 0.30 |
| Color image stabilizing agent ST-2 | 0.20 |
| Color-mixing preventing agent HQ-1 | 0.02 |
| Anti-irradiation dye AI-3 | 0.01 |
| DNP | 0.02 |
| Backing layer | |
| Gelatin | 6.0 |
| Silica (average particle size: 3 $\mu$m) | 0.1 |

The silver halide emulsions used in the above-mentioned emulsion layers are each a monodisperse cubic grain emulsion having a size distribution width of not more than 10%. The emulsion are each subjected to optimal chemical sensitization in the presence of sodium thiosulfate, chloroauric acid, and ammonium thiocyanate, and the optical sensitizing dye and 4-hydroxy-6-methyl-1.3.3a.7-tetraazaindene and STAB-1 were added to the emulsion.

Chemical structures of the compounds used in the sample are shown below.

PVP: Polyvinylpyrrolidone

DBP: Dibutyl phthalate

DOP: Dioctyl phthalate

DNP: Dinonyl phthalate

DIDP: Diisodecyl phthalate

HQ-1: 2,5-di-t-octylhydroquinone

HQ-2: 2,5-di-s-dodecylhydroquinone

HQ-3: 2,5-di-s-tetradecylhydroquinone

HQ-4: 2-s-dodecyl-5-s-tetradecylhydroquinone

SU-1: Sodium i-propylnaphthalenesulfonate

SU-2: Sodium di(ethylhexyl)sulfosuccinate

SU-3: Sodium di(2.2.3.3.4.4.5.5-octafluorobenzyl) sulfosuccinate

STAB-1: 1-(3-acetoamido)phenyl-5-mercaptotetrazole

H-1: $O(CH_2SO_2CH{=}CH_2)_2$

H-2: Sodium salt of 2,4-dichloro-6-hydroxy-s-triazine

Comparative coupler Y-1

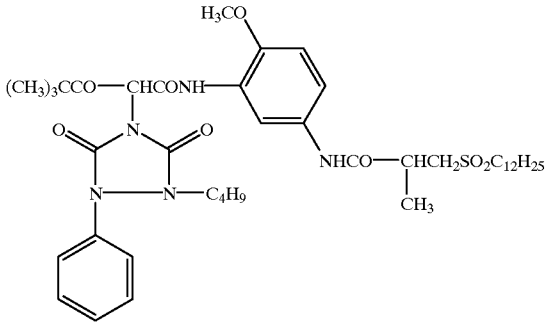

Comparative coupler Y-2

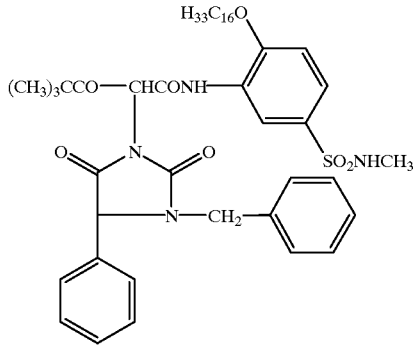

(A coupler described in JP O.P.I. No. 63-38932)

Comparative coupler Y-3

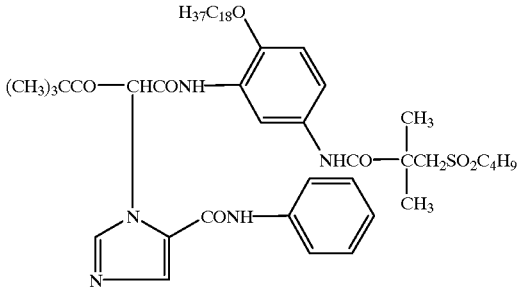

(A coupler described in JP O.P.I. No. 63-3123047)

Comparative coupler Y-4

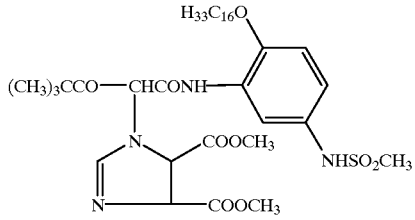

(A coupler described in U.S. Pat. No. 4,388,403)

-continued
Comparative coupler Y-5
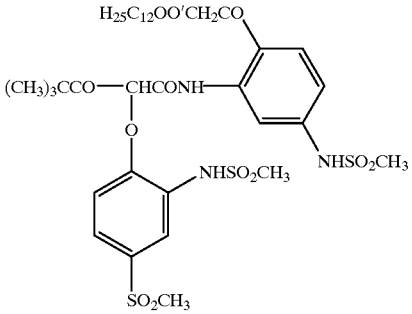
(A coupler described in U.S. Pat. No. 4,388,403)
M-1
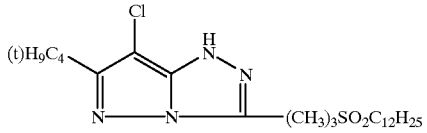
C-1
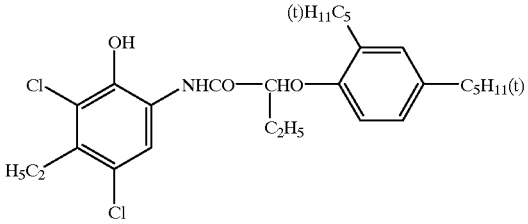
C-2
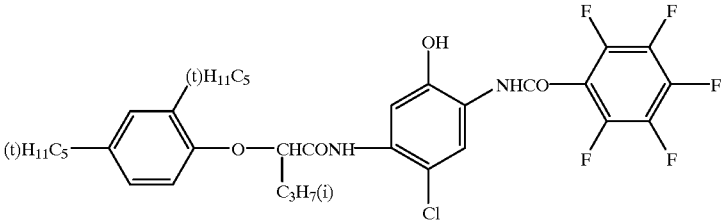
ST-1
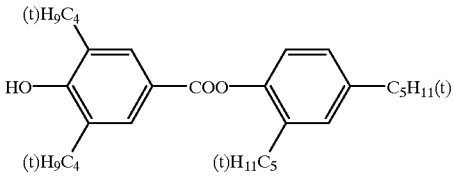
ST-2
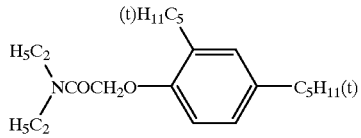
ST-3
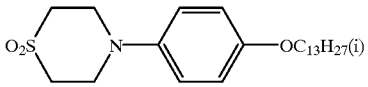
ST-4
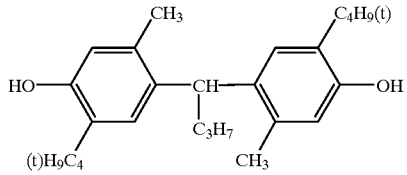
UV-1
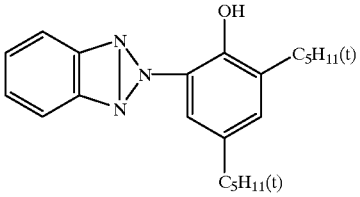
UV-2
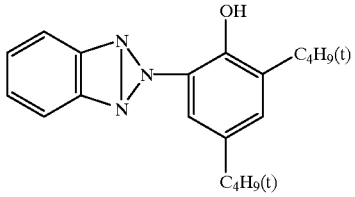
UV-3
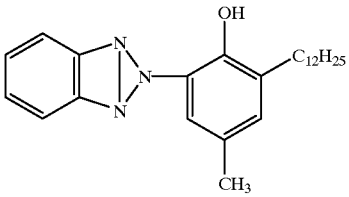
HQ-5
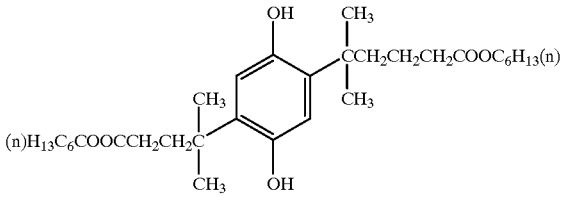

-continued

HBS-1

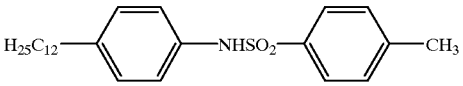

AI-1

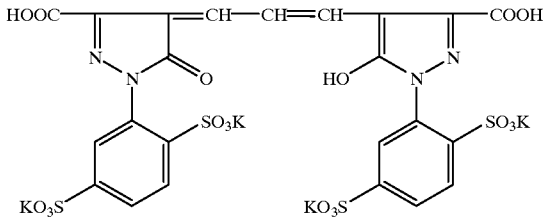

AI-2

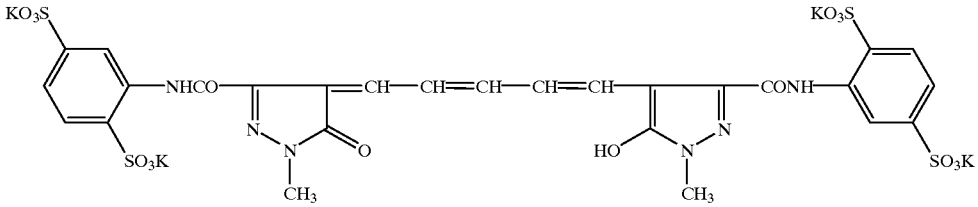

AI-3

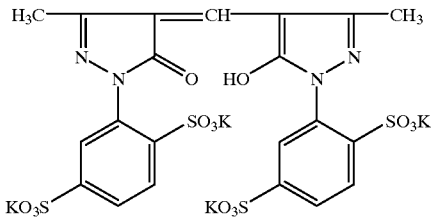

AI-4

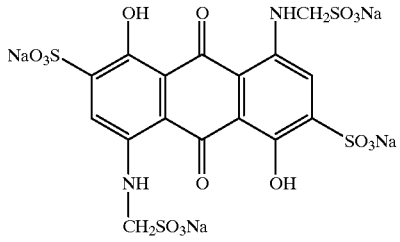

F-1

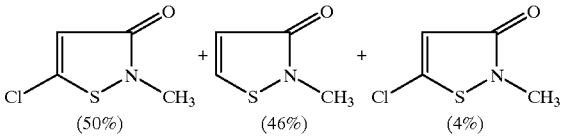

(Molar ratio in the mixture)

Sensitizing dye BS-1

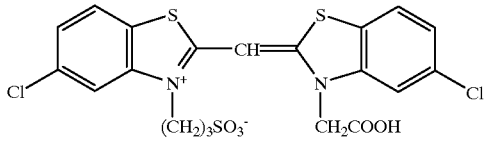

Sensitizing dye GS-1

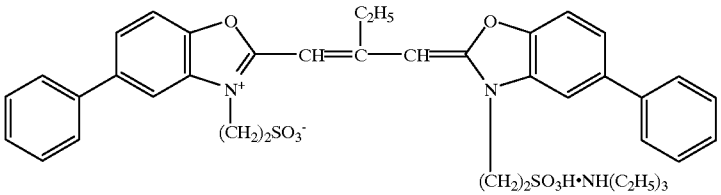

Sensitizing dye RS-1

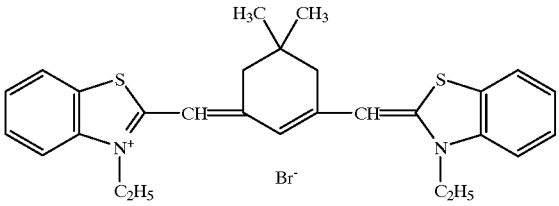

Comparative Samples 102 to 105 and Samples 106 to 114 according to the invention were prepared in the same manner as in Sample 101 except that the yellow coupler Y-1 was replace by the same molar amount of the coupler shown in Table 1.

The samples were each exposed to white light for 0.2 seconds through an optical wedge and processed according to the following processing procedure. The maximum color density $D_{max}$ and the minimum color density $D_{min}$ of the processed samples were measured by blue light using an optical densitometer PDA-65 manufactured by Konica Corp.

Besides, Color Checker, manufactured by Macbeth Co., was photographed by Konica Color Film DD100 and the film was processed to obtain a negative image of the color chart. The negative image was printed to each of the samples so that the image of gray portion of the chart was correctly reproduced. The samples were processed by the following processing procedure. The chromaticity L*a*b* of the image of the yellow chart reproduced on the processed samples were each measured. Then the difference ΔE of the chromaticity of the original chart and that of the reproduced iamge was determined for each of the samples. A smaller value of the ΔE indicates a higher yellow color reproduce ability of the sample. The color reproducibility of each of the samples was ranked according to the following definition. In the followings, $\Delta E_{(101)}$ is the difference of the chromaticity of the original yellow chart and that of the yellow image on Sample 101.

Rank 5 $\Delta E \leqq \frac{1}{3} \cdot \Delta E_{(101)}$

Rank 4 $\frac{1}{3} \cdot \Delta E_{(101)} < \Delta E \leqq \frac{2}{3} \cdot \Delta E_{(101)}$ Rank 3 $\frac{2}{3} \cdot \Delta E_{(101)} < \Delta E \leqq \frac{4}{3} \cdot \Delta E_{(101)}$ Rank 2 $\frac{4}{3} \cdot \Delta E_{(101)} < \Delta E \leqq \frac{5}{3} \cdot \Delta E_{(101)}$ Rank 1 $\frac{5}{3} \cdot \Delta E_{(101)} < \Delta E$ The processed samples were exposed to sun light for 4 weeks and the remained density of yellow image at the portion at which the initial density was 1.0 for evaluation the light-fastness of the color image. Thus obtained results are shown in Table 1.

Processing conditions were as follows.

| Processing | Temperature | Time |
|---|---|---|
| Color development | 35.0 ± 0.3° C. | 45 seconds |
| Bleach-fixing | 35.0 ± 0.5° C. | 45 seconds |
| Stabilizing | 30 to 34° C. | 90 seconds |
| Drying | 60 to 80° C. | 60 seconds |

Developing solution

| | |
|---|---|
| Water | 800 ml |
| Triethanolamine | 10 g |
| N,N-diethylhydroxylamine | 5 g |
| Potassium bromide | 0.02 g |
| Potassium chloride | 2 g |
| Potassium sulfite | 0.3 g |
| 1-hydroxyethylidene-1,1-disulfonic acid | 1.0 g |
| Ethylenediaminetetraacetic acid | 1.0 g |
| Disodium catechol-3,5-disulfonate | 1.0 g |
| Ethylene glycol | 10 g |
| N-ethyl-N-β-methanesulfonamidoethyl-3-methyl-4-aminoaniline sulfonate | 4.5 g |
| Fluorescent whitening agent (4,4'-diamino-stilbenesulfonic acid derivative) | 1.0 g |
| Potassium carbonate | 27 g |
| Water to make | 1 l |
| Adjust pH to 10.10 | |

Bleach-fixing solution

| | |
|---|---|
| Ferric (III) ammonium ethylenediamine-tetraacetate dihydrate | 60 g |
| Ethylenediaminetetraacetic acid | 3 g |
| Ammonium thiosulfate (70% aqueous solution) | 100 ml |
| Ammonium sulfite (40% aqueous solution) | 27.5 ml |
| Water to make | 1 l |
| Adjust pH to 5.7 using potassium carbonate or glacial acetic acid. | |

Stabilizing solution

| | |
|---|---|
| 5-chloro-2-methyl-4-isothiazoline-3-one | 0.2 g |
| 1,2-benzisothiazoline-3-one | 0.3 g |
| Ethylene glycol | 1.0 g |
| 1-hydroxyethylidene-1,1-disulfonic acid | 2.0 g |
| Sodium o-phenylphenol | 1.0 g |
| Ethylenediaminetetraacetic acid | 1.0 g |

-continued

| | |
|---|---|
| Ammonium hydroxide (20% aqueous solution) | 3.0 g |
| Fluorescent whitening agent (4,4'-diamino-stilbenesulfonic acid derivative) | 1.5 g |
| Water to make | 1 l |
| Adjust pH to 7.0 using sulfuric acid or potassium hydroxide. | |

TABLE 1

| Sample No. | Coupler No. | $D_{max}$ | $D_{min}$ | Light-fastness | Color reproducibility | Note |
|---|---|---|---|---|---|---|
| 101 | Y-1 | 2.24 | 0.13 | 0.80 | 3 | Comp. |
| 102 | Y-2 | 2.25 | 0.14 | 0.62 | 2 | Comp. |
| 103 | Y-3 | 2.28 | 0.13 | 0.75 | 3 | Comp. |
| 104 | Y-4 | 2.20 | 0.13 | 0.76 | 3 | Comp. |
| 105 | Y-5 | 2.29 | 0.14 | 0.54 | 3 | Comp. |
| 106 | 2 | 2.33 | 0.13 | 0.85 | 4 | Inv. |
| 107 | 8 | 2.33 | 0.13 | 0.86 | 4 | Inv. |
| 108 | 11 | 2.31 | 0.13 | 0.87 | 4 | Inv. |
| 109 | 14 | 2.30 | 0.13 | 0.89 | 4 | Inv. |
| 110 | 19 | 2.35 | 0.13 | 0.85 | 5 | Inv. |
| 111 | 23 | 2.35 | 0.13 | 0.87 | 5 | Inv. |
| 112 | 25 | 2.37 | 0.13 | 0.85 | 5 | Inv. |
| 113 | 27 | 2.35 | 0.13 | 0.89 | 5 | Inv. |
| 114 | 28 | 2.35 | 0.13 | 0.89 | 5 | Inv. |
| 115 | 32 | 2.33 | 0.13 | 0.85 | 5 | Inv. |

It is understood from the results in Table 1 that the samples each using the yellow coupler according to the invention are higher in the maximum density and excellent in the light-fastness and the color reproducibly compared with the comparative samples. Samples 110 to 115 are particularly excellent in the maximum density and the color reproducibility.

Example 2

A surface of a triacetyl cellulose film support was subjected to a subbing treatment, and layers each having the following constitution were provided in this order from the support on the subbed surface and another surface or back surface of the support. In the followings, the amounts of ingredients are described in grams per square meter except an amount with a particular description. The amount of silver halide and colloidal silver are described in terms of silver.

| | |
|---|---|
| First backing layer | |
| Alumina sol AS-100 (Aluminum oxide manufactured by Nikko Kagaku Kogyo Co.) | 100 mg |
| Diacetyl cellulose | 200 mg |
| Second backing layer | |
| Diacetyl cellulose | 100 mg |
| Stearic acid | 10 mg |
| Fine particle of silica (Average particle size: 0.2 μm) | 50 mg |

The following layers were provided on the subbed surface of the triacetyl cellulose film support in this order from the support to prepare Sample 201 of multilayered color photographic light-sensitive material.

| | |
|---|---|
| First layer: Antihalation layer HC | |
| Black colloidal silver | 0.15 g |
| UV absorbent UV-4 | 0.20 g |
| Compound CC-1 | 0.02 g |
| High-boiling solvent DOP | 0.20 g |
| High-boiling solvent TCP | 0.20 g |
| Gelatin | 1.6 g |
| Second layer: Interlayer IL-1 | |
| Gelatin | 1.3 g |
| Third layer: Low speed red-sensitive emulsion layer RL | |
| Silver iodobromide emulsion (Average grain size: 0.3 μm, average iodide content: 2.0 mole-%) | 0.4 g |
| Silver iodobromide emulsion (Average grain size: 0.4 μm, average iodide content: 8.0 mole-%) | 0.3 g |
| Sensitizing dye S-1 | $3.2 \times 10^{-4}$ moles/mole of silver |
| Sensitizing dye S-2 | $3.2 \times 10^{-4}$ moles/mole of silver |
| Sensitizing dye S-3 | $0.2 \times 10^{-4}$ moles/mole of silver |
| Cyan coupler C-3 | 0.50 g |
| Cyan coupler C-4 | 0.13 g |
| Colored cyan coupler CC-1 | 0.07 g |
| DIR compound D-1 | 0.006 g |
| DIR compound D-2 | 0.01 g |
| High-boiling solvent DOP | 0.55 g |
| Gelatin | 1.0 g |
| Fourth layer: High speed red-sensitive emulsion layer RH | |
| Silver iodobromide emulsion (Average grain size: 0.7 μm, average iodide content: 7.5 mole-%) | 0.9 g |
| Sensitizing dye S-1 | $1.7 \times 10^{-4}$ moles/mole of silver |
| Sensitizing dye S-2 | $1.6 \times 10^{-4}$ moles/mole of silver |
| Sensitizing dye S-3 | $0.1 \times 10^{-4}$ moles/mole of silver |
| Cyan coupler C-4 | 0.23 g |
| Colored cyan coupler CC-1 | 0.03 g |
| DIR compound D-2 | 0.02 g |
| High-boiling solvent DOP | 0.25 g |
| Gelatin | 1.0 g |
| Fifth layer: Interlayer IL-2 | |
| Gelatin | 0.8 g |
| Sixth layer: Low speed green-sensitive emulsion layer G-L | |
| Silver iodobromide emulsion (Average grain size: 0.4 μm, average iodide content: 8.0 mole-%) | 0.6 g |
| Silver iodobromide emulsion (Average grain size: 0.3 μm, average iodide content: 2.0 mole-%) | 0.2 g |
| Sensitizing dye S-4 | $6.7 \times 10^{-4}$ moles/mole of silver |
| Sensitizing dye S-5 | $0.8 \times 10^{-4}$ moles/mole of silver |
| Magenta coupler M-2 | 0.17 g |
| Magenta coupler M-3 | 0.43 g |
| Colored magenta coupler CM-1 | 0.10 g |
| DIR compound D-3 | 0.02 g |
| High-boiling solvent TCP | 0.7 g |
| Gelatin | 1.0 g |
| Seventh layer: High speed green-sensitive emulsion layer G-H | |
| Silver iodobromide emulsion (Average grain size: 0.7 μm, average iodide content: 7.5 mole-%) | 0.9 g |

-continued

| | |
|---|---|
| Sensitizing dye S-6 | $1.1 \times 10^{-4}$ moles/mole of silver |
| Sensitizing dye S-7 | $2.0 \times 10^{-4}$ moles/mole of silver |
| Sensitizing dye S-8 | $0.3 \times 10^{-4}$ moles/mole of silver |
| Magenta coupler M-2 | 0.30 g |
| Magenta coupler M-3 | 0.13 g |
| Colored magenta coupler CM-1 | 0.04 g |
| DIR compound D-3 | 0.004 g |
| High-boiling solvent TCP | 0.35 g |
| Gelatin | 1.0 g |
| Eighth layer: Yellow filter layer YC | |
| Yellow colloidal silver | 0.1 g |
| Additive HS-1 | 0.07 g |
| Additive HS-2 | 0.07 g |
| Additive SC-1 | 0.12 g |
| High-boiling solvent TCP | 0.15 g |
| Gelatin | 1.0 g |
| Ninth layer: Low speed blue-sensitive emulsion layer B-L | |
| Silver iodobromide emulsion (Average grain size: 0.3 μm, average iodide content: 2.0 mole-%) | 0.25 g |
| Silver iodobromide emulsion (Average grain size: 0.4 μm, average iodide content: 8.0 mole-%) | 0.25 g |
| Sensitizing dye S-9 | $5.8 \times 10^{-4}$ moles/mole of silver |
| Yellow coupler Y-6 | 0.95 g |
| DIR compound D-1 | 0.003 g |
| DIR compound D-2 | 0.006 g |
| High-boiling solvent TCP | 0.18 g |
| Gelatin | 1.3 g |
| Tenth layer: High speed blue-sensitive emulsion layer B-H | |
| Silver iodobromide emulsion (Average grain size: 0.8 μm, average iodide content: 8.5 mole-%) | 0.5 g |
| Sensitizing dye S-10 | $3 \times 10^{-4}$ moles/mole of silver |
| Sensitizing dye S-11 | $1.2 \times 10^{-4}$ moles/mole of silver |
| Yellow coupler Y-6 | 0.20 g |
| High-boiling solvent TCP | 0.05 g |
| Gelatin | 1.0 g |
| Eleventh layer: First protective layer PRO-1 | |
| Silver iodobromide (Average size: 0.08 μm) | 0.3 g |
| UV absorbent UV-4 | 0.07 g |
| UV absorbent UV-5 | 0.10 g |
| Additive HS-1 | 0.2 g |
| Additive HS-2 | 0.1 g |
| High-boiling solvent DOP | 0.07 g |
| High-boiling solvent DBP | 0.07 g |
| Gelatin | 0.8 g |
| Twelfth layer: Second protective layer PRO-2 | |
| WAX-1 | 0.04 g |
| SU-5 | 0.004 g |
| Polymethyl methacrylate (Average particle size: 3 μm) | 0.02 g |
| Copolymer of methyl methacrylate, ethyl methacrylate and methacrylic acid in a weight ratio of 3:3:4 (Average particle size: 3 μm) | 0.13 g |

The silver halide emulsions used in the sample were each a core/shell type monodisperse emulsion having a size distribution width of not more than 20%. The emulsion were each subjected an optimal chemical sensitization in the presence of sodium thiosulfate, chloroauric acid and ammonium thiocyanate and the sensitizing dyes, 4-hydroxy-6-methyl-1,3,3a,7-tetraazaindene and 1-phenyl-5-mercaptotetrazole were added to the emulsion.

C-3
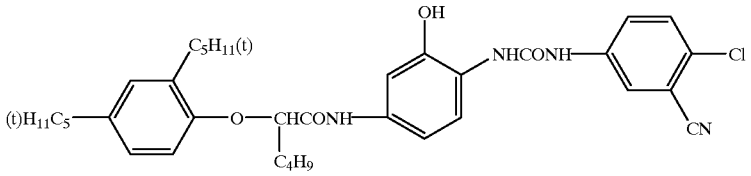
C-4
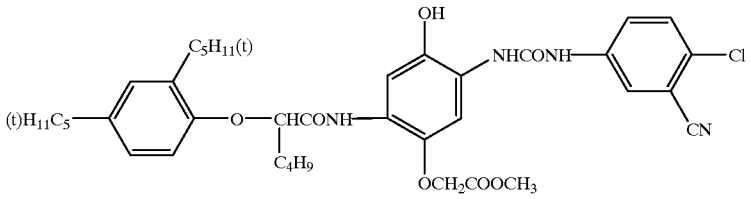
M-2
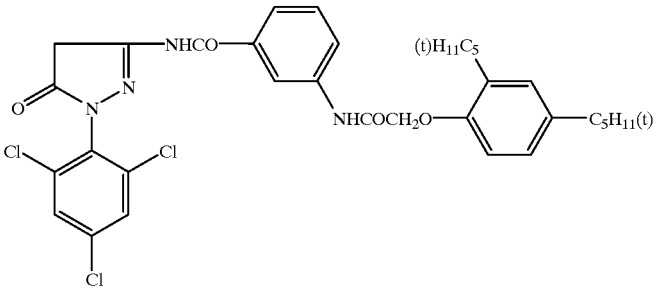
M-3
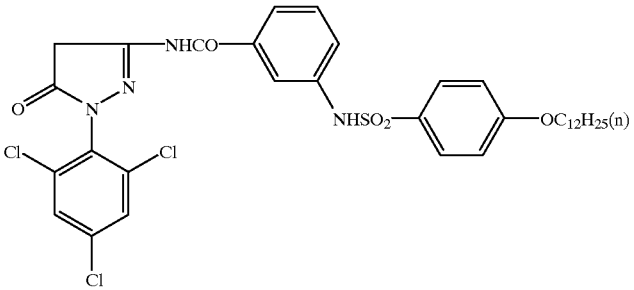
Y-6
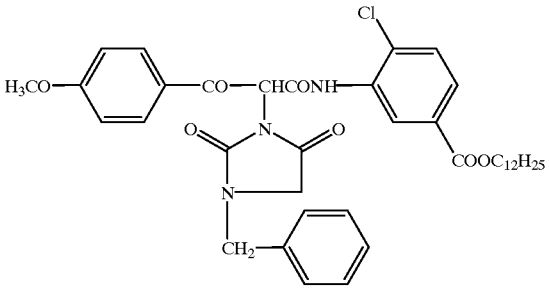
CC-1
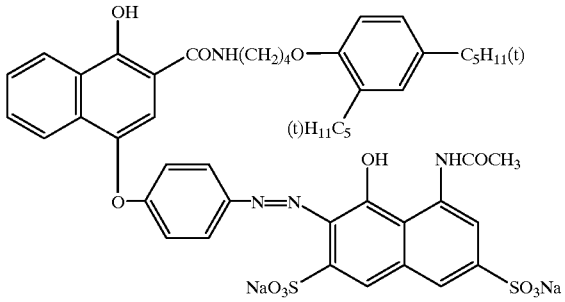

-continued
CM-1
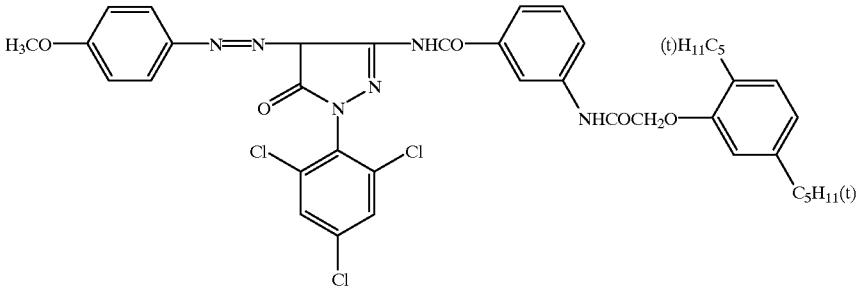
D-1
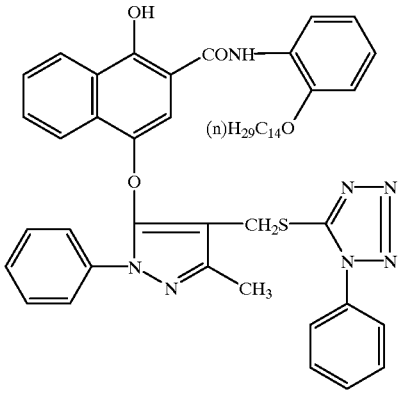
D-2
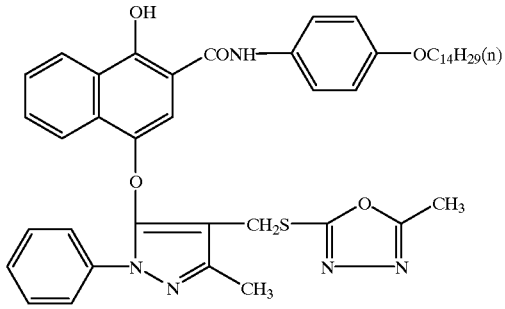
D-3
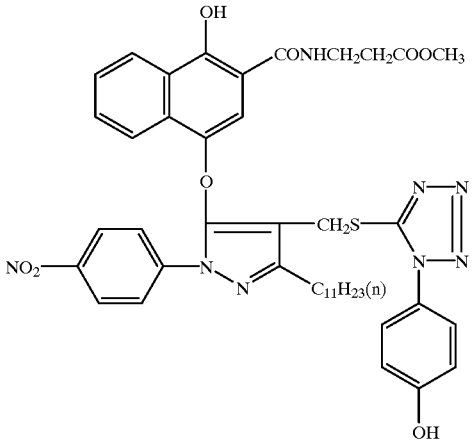
UV-4
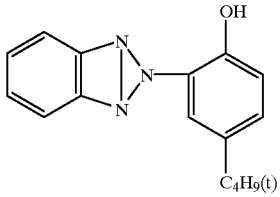
UV-5
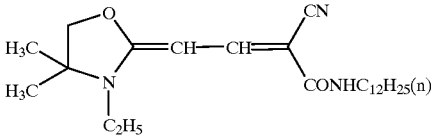
S-1
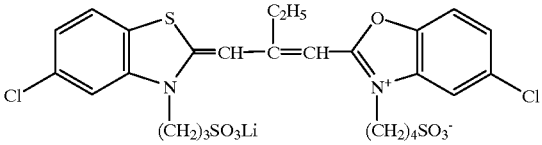
S-2
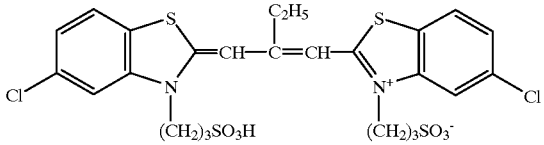
S-3
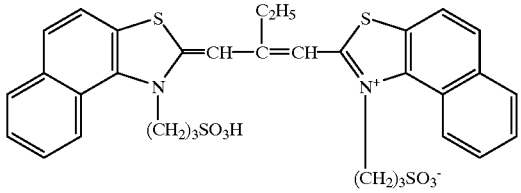

-continued
S-4
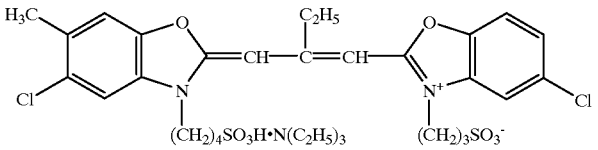
S-5
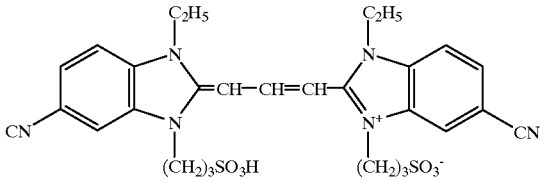
S-6
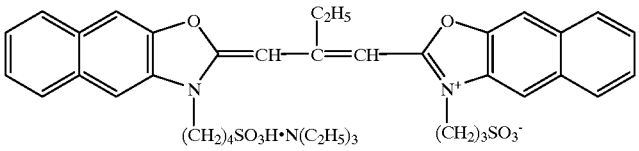
S-7
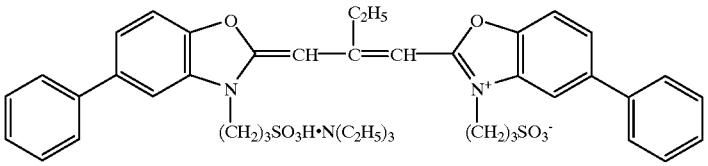
S-8
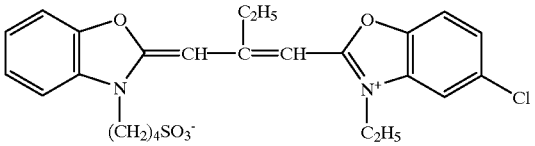
S-9
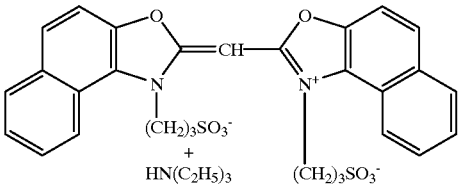
S-10
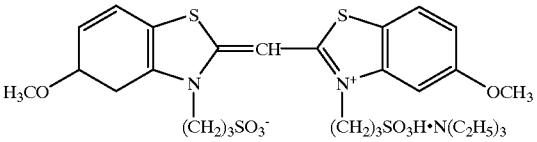
S-11
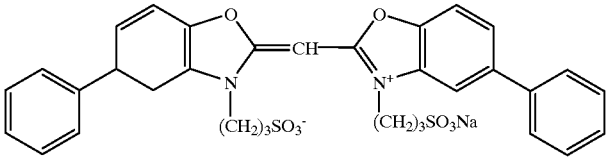
HS-1
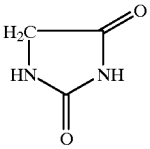
HS-2
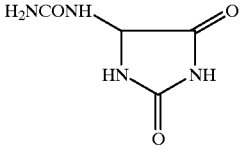
SC-1
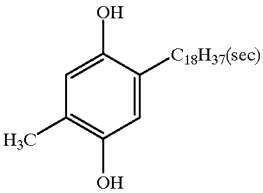
and
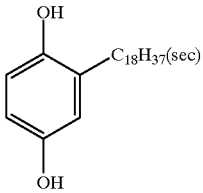
Mixture in a ratio of 2:3
WAX-1
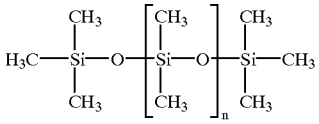
Weight average molecular weight MW: 3,000
SU-5
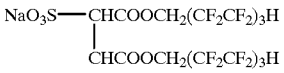

The above-mentioned Sample 201 further contained Compounds SU-1 and SU-4, Hardeners H-1 and H-2, Stabilizer ST-5, Antifoggant AF-1 and AF-2 containing one having a weight average molecular weight of 10,000 and one having a weight average molecular weight of 1,100,000, Dyes AI-5 and AI-6, and 9.4 mg/$M^2$ of Compound F-1.

SU-4

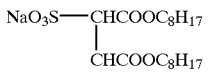

AI-5

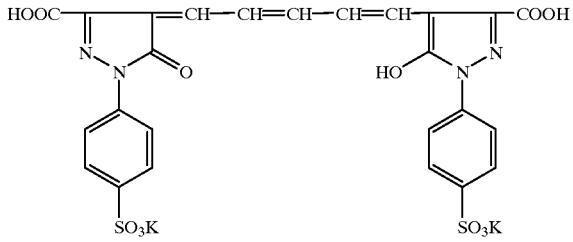

AI-6

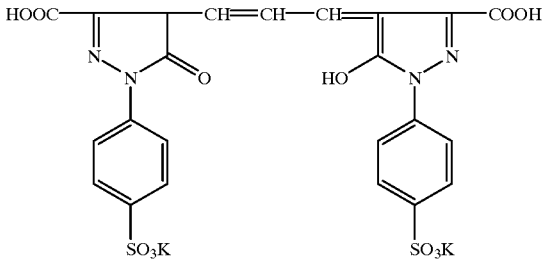

ST-5

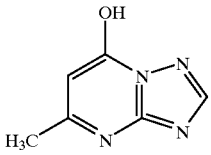

AF-1

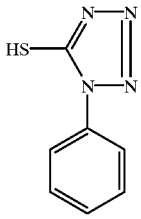

AF-2

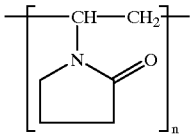

Samples 202 to 206 were prepared in the same manner as in Sample 201 except that yellow coupler Y-6 contained in the ninth and tenth layers was replaced by equal moles of the yellow coupler shown in Table 2.

The samples were each exposed to white light through an optical wedge for 1/100 seconds and processed according to the following processing procedure. The maximum color density and the minimum color density of each of the processed samples were measured by an optical densitometer PDA-65, manufactured by Konica Corporation. Thus obtained results are shown in Table 2.

Processing procedure

| Processing | Time | Temperature | Replenishing amount |
|---|---|---|---|
| Color developing | 3 min. 15 sec. | 38 ± 0.3° C. | 780 ml |
| Bleaching | 45 sec. | 38 ± 2.0° C. | 150 ml |
| Fixing | 1 min. 30 sec. | 38 ± 2.0° C. | 830 ml |
| Stabilizing | 60 sec. | 38 ± 5.0° C. | 830 ml |
| Drying | 1 min. | 55 ± 5.0° C. | |

The replenishing amount is a volume of the replenisher per square meter of the light-sensitive material processed.

The following color developer, bleaching solution, stabilizer, and replenisher for them were used.

Color developer

| | |
|---|---|
| Water | 800 ml |
| Potassium carbonate | 30 g |
| Sodium hydrogen carbonate | 2.5 g |
| Potassium sulfite | 3.0 g |
| Sodium bromide | 1.3 g |
| Potassium iodide | 1.2 mg |
| Hydroxylamine sulfate | 2.5 g |
| Sodium chloride | 0.6 g |
| 4-amino-3-methyl-N-ethyl-N-(β-hydroxyethyl)aniline sulfate | 4.5 g |
| Diethylenetriaminepentaacetic acid | 3.0 g |
| Potassium hydroxide | 1.2 g |
| Water to make | 1 l |

Adjust pH to 10.06 by potassium hydroxide or 20% sulfuric acid.

Color developer replenisher

| | |
|---|---|
| Water | 800 ml |
| Potassium carbonate | 35 g |
| Sodium hydrogen carbonate | 3 g |
| Potassium sulfite | 5 g |
| Sodium bromide | 0.4 g |
| Hydroxylamine sulfate | 3.1 g |
| 4-amino-3-methyl-N-ethyl-N-(β-hydroxyethyl)aniline sulfate | 6.3 g |
| Potassium hydroxide | 2 g |
| Diethylenetriaminepentaacetic acid | 3.0 g |
| Water to make | 1 l |

Adjust pH to 10.18 by potassium hydroxide or 20% sulfuric acid.

Bleaching solution

| | |
|---|---|
| Water | 700 ml |
| Ferric (III) ammonium 1,3-diamino-propanetetraacetate | 125 g |
| Ethylenediaminetetraacetic acid | 2 g |
| Sodium nitrate | 40 g |
| Ammonium bromide | 150 g |
| Glacial acetic acid | 40 g |
| Water to make | 1 l |

Adjust pH to 4.4 by ammonia water of glacial acetic acid.

Bleaching solution replenisher

| | |
|---|---|
| Water | 700 ml |
| Ferric (III) ammonium 1,3-diamino-propanetetraacetate | 175 g |
| Ethylenediaminetetraacetic acid | 2 g |
| Sodium nitrate | 50 g |
| Ammonium bromide | 200 g |
| Glacial acetic acid | 56 g |

Water to make 1 liter after adjusting pH to 4.0 by ammonia water or glacial acetic acid.

-continued

| Fixer | |
|---|---|
| Water | 800 ml |
| Ammonium thiocyanate | 120 g |
| Ammonium thiosulfate | 150 g |
| Sodium sulfite | 15 g |
| Ethylenediaminetetraacetic acid | 2 g |
| Water to make 1 l after adjusting pH to 6.2 by ammonia water or glacial acetic acid. | |
| Fixer replenisher | |
| Water | 800 ml |
| Ammonium thiocyanate | 150 g |
| Ammonium thiosulfate | 180 g |
| Sodium sulfite | 20 g |
| Ethylenediaminetetraacetic acid | 2 g |
| Water to make 1 liter after adjusting pH to 6.5 by ammonia water or glacial acetic acid. | |
| Stabilizer and stabilizer replenisher | |
| Water | 900 ml |
| p-octylphenoloxy-deca(ethyleneoxy)hydrogen | 2.0 g |
| Dimethylolurea | 0.5 g |
| Hexamethylenetetramine | 0.2 g |
| 1,2-benziosthiazoline-3-one | 0.1 g |
| Siloxane (L-77, manufactured by UCC) | 0.1 g |
| Ammonia water | 0.5 ml |
| Water to make | 1 l |
| Adjust pH to 8.5 by ammonia water or 50% sulfuric acid. | |

TABLE 2

| Sample No. | Coupler No. | $D_{max}$ | $D_{min}$ | Note |
|---|---|---|---|---|
| 201 | Y-6 | 3.00 | 0.64 | Comparative |
| 202 | 41 | 3.18 | 0.62 | Inventive |
| 203 | 42 | 3.19 | 0.61 | Inventive |
| 204 | 45 | 3.18 | 0.60 | Inventive |
| 205 | 46 | 3.20 | 0.60 | Inventive |
| 206 | 48 | 3.11 | 0.60 | Inventive |

The results in Table 2 show that the samples using the couplers according to the invention are higher in the maximum density and lower in the fog compared with the comparative samples.

Example 3

A surface of a triacetyl cellulose film support was subjected to a subbing treatment, and layers each having the following composition were provided in this order from the support on the subbed surface and another surface or back surface of the support. In the followings, the amount of ingredients are described in grams per square meter except an amount with a particular description. The amount of silver halide and colloidal silver are described in terms of silver.

| First backing layer | |
|---|---|
| Alumina sol AS-100 (Aluminum oxide manufactured by Nikko Kagaku Kogyo Co.) | 0.8 g |
| Second backing layer | |
| Diacetyl cellulose | 110 mg |
| Stearic acid | 10 mg |

-continued

| | |
|---|---|
| Fine particle of silica (Average particle size: 0.2 μm) | 50 mg |

On the subbed surface of the triacetyl cellulose film support, layers each having the following composition were provided in this order from the support to prepare a multi-layered color light-sensitive material sample 103.

| First layer: Antihalation layer | |
|---|---|
| Black colloidal silver | 0.24 g |
| UV absorbent UV-4 | 0.14 g |
| UV absorbent UV-2 | 0.072 g |
| UV absorbent UV-6 | 0.072 g |
| UV absorbent UV-7 | 0.072 g |
| High-boiling solvent DEHP | 0.31 g |
| High-boiling solvent DBP | 0.098 g |
| Poly-N-vinylpyrrolidone | 0.15 g |
| Gelatin | 2.02 g |
| Second layer: Interlayer | |
| High-boiling solvent TCP | 0.011 g |
| Gelatin | 1.17 g |
| Third layer: Low speed red-sensitive layer | |
| Silver iodobromide emulsion spectrally sensitized by red-sensitizing dyes S-12 and S-13 (AgI: 3.0 mole-%), Average size: 0.30 μm) | 0.60 |
| Coupler C-5 | 0.37 g |
| High-boiling solvent DBP | 0.093 g |
| poly-N-vinylpyrrolidone | 0.074 g |
| Gelatin | 1.35 g |
| Fourth layer: High speed red-sensitive layer | |
| Silver iodobromide emulsion spectrally sensitized by red-sensitizing dyes S-12 and S-13 (AgI: 3.0 mole-%), Average size: 0.80 μm) | 0.60 |
| Coupler C-5 | 0.85 g |
| High-boiling solvent DBP | 0.21 |
| poly-N-vinylpyrrolidone | 0.093 g |
| Gelatin | 1.56 g |
| Fifth layer: Interlayer | |
| Color mixing preventing agent SC-1 | 0.20 g |
| High-boiling solvent TCP | 0.25 g |
| Matting agent MA-1 | 0.0091 g |
| Gelatin | 1.35 g |
| Sixth layer: Low speed green-sensitive layer | |
| Silver iodobromide emulsion spectrally sensitized by green-sensitizing dye S-14 (AgI: 3.0 mole-%), Average size: 0.30 μm) | 0.70 g |
| Coupler M-4 | 0.31 g |
| Coupler M-5 | 0.076 g |
| High-boiling solvent TCP | 0.059 g |
| Poly-N-vinylpyrrolidone | 0.074 g |
| Gelatin | 1.29 g |
| Seventh layer: High speed green-sensitive layer | |
| Silver iodobromide emulsion spectrally sensitized by green-sensitizing dye S-14 (AgI: 3.0 mole-%), Average size: 0.80 μm) | 0.70 g |
| Coupler M-4 | 0.80 g |
| Coupler M-5 | 0.19 g |
| Color mixing preventing agent SC-1 | 0.055 g |
| High-boiling solvent TCP | 0.16 g |
| Poly-N-vinylpyrrolidone | 0.12 g |
| Gelatin | 1.91 g |
| Eighth layer: Interlayer | |
| Gelatin | 0.90 g |
| Ninth layer: Yellow filter layer | |
| Yellow colloidal silver | 0.11 g |

-continued

| | |
|---|---|
| Color mixing preventing agent SC-1 | 0.068 g |
| High-boiling solvent TCP | 0.085 g |
| Matting agent MA-1 | 0.012 g |
| Gelatin | 0.68 g |
| Tenth layer: Low speed blue-sensitive layer | |
| Silver iodobromide emulsion spectrally sensitized by blue-sensitizing dye S-15 (AgI: 3.0 mole-%), Average size: 0.30 μm) | 0.70 g |
| Coupler Y-7 | 0.86 g |
| Image stabilizing agent G-1 | 0.012 g |
| High-boiling solvent TCP | 0.22 g |
| Poly-N-vinylpyrrolidone | 0.078 g |
| Additive HS-2 | 0.020 g |
| Additive HS-1 | 0.040 g |
| Gelatin | 1.09 g |
| Eleventh layer: High speed blue-sensitive layer | |
| Silver iodobromide emulsion spectrally sensitized by blue-sensitizing dye S-15 (AgI: 3.0 mole-%), Average size: 0.85 μm) | 0.70 g |
| Coupler Y-7 | 1.24 g |
| Image stabilizing agent G-1 | 0.017 g |
| High-boiling solvent TCP | 0.31 g |
| Poly-N-vinylpyrrolidone | 0.10 g |
| Additive HS-2 | 0.039 g |
| Additive HS-1 | 0.077 g |
| Gelatin | 1.73 g |
| Twelfth layer: Protective layer-1 | |
| Non-light-sensitive silver iodobromide fine grains (AgI: 1.0 mole-%), average size: 0.08 μm) | 0.075 g |
| UV absorbent UV-4 | 0.048 g |
| UV absorbent UV-2 | 0.024 g |
| UV absorbent UV-6 | 0.024 g |
| UV absorbent UV-7 | 0.024 g |
| High-boiling solvent DEHP1 | 0.13 g |
| High-boiling solvent DBP | 0.13 g |
| Additive HS-2 | 0.075 g |
| Additive HS-1 | 0.15 g |
| Gelatin | 1.2 g |
| Thirteenth layer: Protective layer-2 | |
| Lubricant WAX-1 | 0.041 g |
| Matting agent MA-2 | 0.0090 g |
| Matting agent MA-3 | 0.051 g |
| Surfactant SU-5 | 0.0036 g |
| Gelatin | 0.55 g |

The poly-N-vinylpyrrolidone used in the layers was one having a weight average molecular weight of 350,000.

In the light-sensitive material Sample 301, gelatin hardeners H-1, H-2 and H-3, water-soluble dyes AI-5, AI-6 and AI-7, compound DI-1, stabilizing agent ST-5 and antifoggant AF-1 were optimally added.

The silver halide emulsions used in the light-sensitive layers were each a monodisperse emulsion having a grain size distribution width of not more than 20%. Each of the emulsions was subjected to an optimal chemical ripening in the presence of sodium thiosulfate, chloroauric acid and ammonium thiocyanate after desalted by washing. The sensitizing dye for spectrally sensitizing the emulsion, 4-hydroxy-6-methyl-1,3,3a,7-tetraazaindene and 1-phenyl-5-mercaptotetrazole were added to each the emulsion.

The width of the grain size distribution is defined by the following equation.

Grain size distribution width (%)=

Standard deviation of grain size/Average grain size×100

S-12

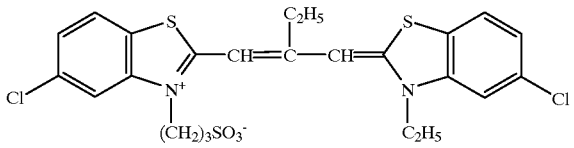

S-13

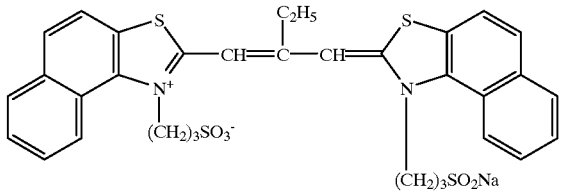

S-14

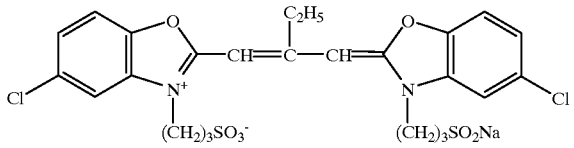

S-15

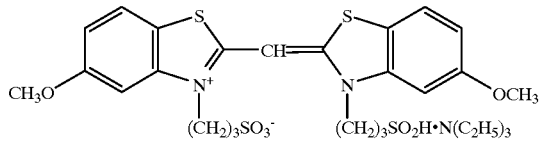

C-5

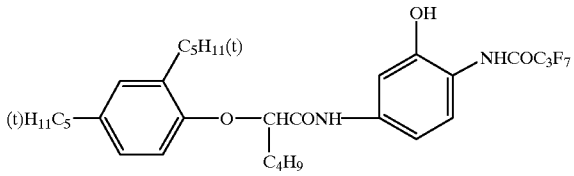

M-4

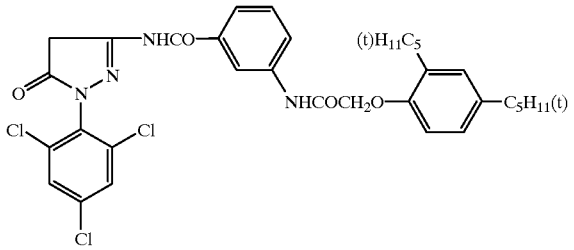

M-5

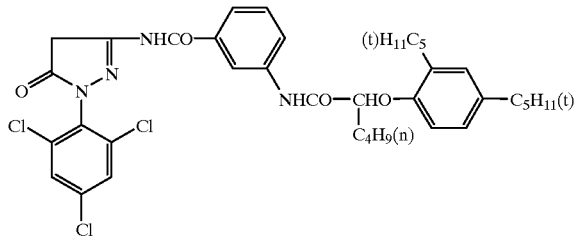

-continued

Y-7

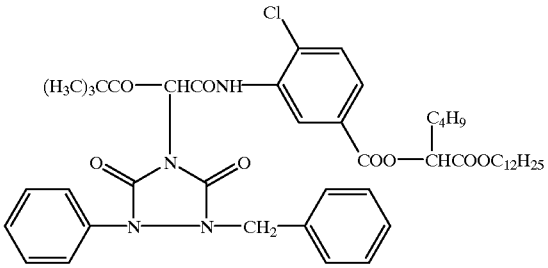

Matting agent

MA-1

Colloidal silica particles (Average size: 3.5μm)

MA-2

Polymethyl methacrylate particles (Average size: 3.0 μm)

MA-3

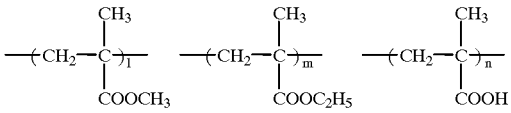

Weight ratio of l:m:n = 30:30:40

UV absorbent

UV-6

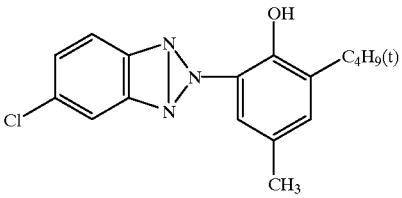

UV-7

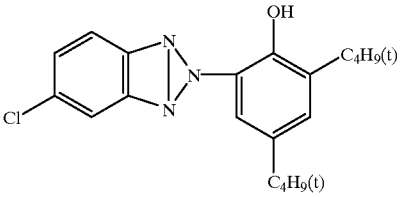

Image stabilizing agent

G-1

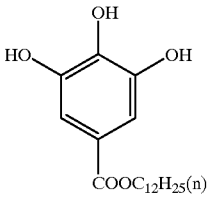

H-3

$[(CH_2{=}CHSO_2CH_2)_3CCH_2SO_2(CH_2)_2]_2N(CH_2)_2SO_3K$

AI-5

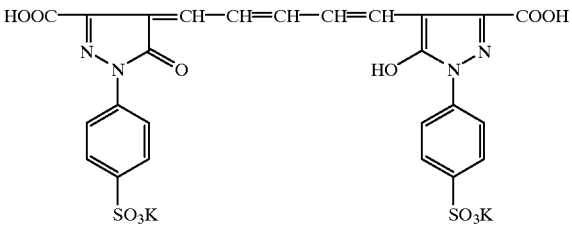

-continued

AI-6

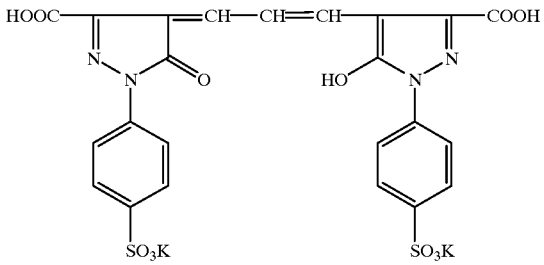

AI-7

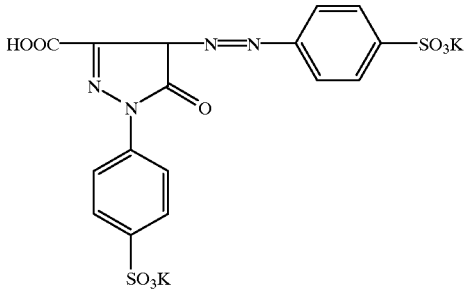

Samples 302 through 304 according to the invention were prepared in the same manner as in Sample 301 except that the yellow coupler in the tenth and eleventh layer was replaced by equimolar amount of the coupler shown in Table 3.

The samples were each exposed to white light through an optical wedge for 1/100 seconds and processed according to the following processing procedure. The maximum color density and the minimum color density of each of the processed samples were measured by an optical densitometer PDA-65, manufactured by Konica Corporation.

As a result, it was found that the inventive samples using the coupler according to the invention formed images each having a higher color maximum density and lower fog density compared with the comparative sample.

TABLE 3

| Sample No. | Coupler No. | Note |
|---|---|---|
| 301 | Y-7 | Comparative |
| 302 | 30 | Inventive |
| 303 | 32 | Inventive |
| 304 | 33 | Inventive |

| Process | Time | Temperature |
|---|---|---|
| First developing | 6 minutes | 38° C. |
| Washing | 2 minutes | 38° C. |
| Reversing | 2 minutes | 38° C. |
| Color developing | 6 minutes | 38° C. |
| Modulating | 2 minutes | 38° C. |
| Bleaching | 6 minutes | 38° C. |
| Fixing | 4 minutes | 38° C. |
| Washing | 4 minutes | 38° C. |
| Stabilizing | 1 minute | Ordinary temperature |
| Drying | | |

The processing solutions used in the above-mentioned processing were as follows.

| | |
|---|---|
| **First developer** | |
| Sodium tetrapolyphosphate | 2 g |
| Sodium sulfite | 20 g |
| Hydroquinone monosulfonate | 30 g |
| Sodium carbonate monohydrate | 30 g |
| 1-phenyl-4-methyl-4-hydroxymethyl-3-pyrazolidone | 2 g |
| Potassium bromide | 2.5 g |
| Potassium thiocyanate | 1.2 g |
| Potassium iodide (0.1% solution) | 2 ml |
| Water to make | 1000 ml |
| Adjust pH to 9.60. | |
| **Reversing solution** | |
| Hexasodium nitrilotrimethylenesulfonate | 3 g |
| Stannous chloride dihydrate | 1 g |
| p-aminophenol | 0.1 g |
| Sodium hydroxide | 8 g |
| Glacial acetic acid | 15 ml |
| Water to make | 1000 ml |
| Adjust pH to 5.75. | |
| **Color developer** | |
| Sodium tetrapolyphosphate | 3 g |
| Sodium sulfite | 7 g |
| Trisodium phosphate dihydrate | 36 g |
| Potassium bromide | 1 g |
| Potassium iodide (0.1% solution) | 90 ml |
| Sodium hydroxide | 3 g |
| Citrazic acid | 1.5 g |
| N-ethyl-N-β-mehtanesulfonamidoethyl-3-methyl-4-aminoaniline sulfate | 11 g |
| 2,2-ethylenedithioethanol | 1 g |
| Water to make | 1000 ml |
| Adjust pH to 11.70. | |
| **Modulating solution** | |
| Sodium sulfite | 12 g |
| Sodium ethylenediaminetetraacetate dihydrate | 8 g |
| Thioglycelin | 0.4 ml |
| Glacial acetic acid | 3 ml |
| Water to make | 1000 ml |
| Adjust pH to 6.15. | |
| **Bleaching solution** | |
| Sodium ethylenediaminetetraacetate dihydrate | 2 g |
| Ferric (III) ammonium ethylenediamine-tetraacetate dihydrate | 120 g |
| Ammonium bromide | 100 g |
| Water to make | 1000 ml |
| Adjust pH to 5.65. | |
| **Fixer** | |
| Ammonium thiosulfate | 80 g |
| Sodium sulfite | 5 g |
| Sodium bisulfite | 5 g |
| Water to make | 1000 ml |
| Adjust pH to 6.60. | |
| **Stabilizing solution** | |
| Formalin (37 weight-%) | 5 ml |
| Konidacks (Konica Corporation) | 5 ml |
| Water to make | 1000 ml |
| Adjust pH to 7.00. | |

What is claimed is:

1. A silver halide color photographic light-sensitive material comprising a support having thereon a blue-sensitive silver halide emulsion layer containing a yellow dye-forming coupler represented by the following Formula I;

Formula I

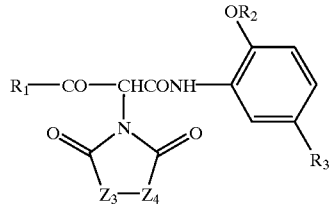

wherein $R_1$ is an aliphatic group or an aromatic group, $R_2$ is a straight or branched chain alkyl group having 8 to 21 carbon atoms or an alkyl group, $R_3$ is a hydrogen atom or halogen atom, $Z_3$ is >N—$R_2$, in which $R_{21}$ is a hydrogen atom, an aryl group, a cycloalkyl group, an aryl group, a heterocyclic group, or —O—, $Z_4$ is >N—$R_{22}$ in which $R_{22}$ is a hydrogen atom, an alkyl group, a cycloalkyl group, an aryl group, a heterocyclic group, or >C($R_{23}$) ($R_{24}$) in which $R_{23}$ and $R_{24}$ are each a hydrogen atom or a substituent.

2. The silver halide color photographic light-sensitive material of claim 1, wherein $R_3$ is a chlorine atom.

3. The silver halide color photographic light-sensitive material of claim 1 wherein $R_2$ is a straight-chain alkyl group having 8 to 21 carbon atoms.

4. The silver halide color photographic light-sensitive material of claim 1, wherein the substituent is a halogen atom, an alkyl group, an aryl group, an alkoxy group, an aryloxy group, a sulfonyl group, an acylamino group, a sulfonylamino group, hydroxyl group, a nitro group, a cyano group, an amino group, an anilino group, alkylthio group, or an alkyl group.

5. A silver halide color photographic light-sensitive material comprising a support having thereon a blue sensitive silver halide layer containing a yellow dye-forming coupler represented by the following Formula I-a.

Formula I-a

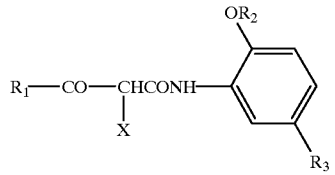

wherein $R_1$ is a t-butyl group, $R_2$ is a straight or branched chain alkyl group having 8 to 21 carbon atoms or an aryl group, $R_3$ is a hydrogen atom or a halogen atom, and X is represented by a formula selected from the group consisting of Formula IV to IX;

Formula IV

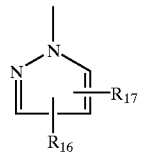

-continued

Formula V

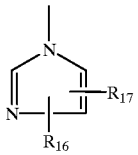

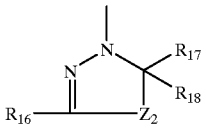

Formula VIII

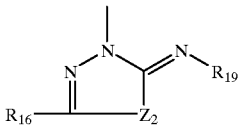

Formula IX

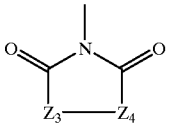

wherein $R_{16}$, $R_{17}$ and $R_{18}$ are each a group capable of being a substituent of the nitrogen-containing heterocyclic ring, $R_{19}$ is a substituent, $Z_2$ is >N—$R_{20}$, —O— or —S(O)k— in which k is 0, 1 or 2, $Z_3$ is >N—$R_2$, or —O—, $Z_4$ is >N—$R_{22}$ or >C ($R_{23}$) ($R_{24}$), $R_{20}$, $R_{21}$ and $R_{22}$ are each a hydrogen atom, an alkyl group, a cycloalkyl group, an aryl group or a heterocyclic group, $R_{13}$ and $R_{24}$ are each a hydrogen atom or a substituent.

6. The silver halide color photographic light-sensitive material according to claim 5 wherein $R_3$ is a chlorine atom.

7. The silver halide color photographic light-sensitive material according to claim 5 wherein X is the group represented by Formula IX.

8. The silver halide color photographic light-sensitive material of claim 5 wherein $R_2$ is a straight-chain alkyl group having 8 to 21 carbon atoms.

9. The silver halide color photographic light-sensitive material of claim 7 wherein $R_3$ is a chlorine atom.

10. The silver halide color photographic light-sensitive material of claim 9 wherein $R_2$ is a straight-chain alkyl group having 8 to 21 carbon atoms.

* * * * *